US010695608B2

(12) United States Patent
Engelfried, Jr.

(10) Patent No.: US 10,695,608 B2
(45) Date of Patent: Jun. 30, 2020

(54) MULTI-FUNCTIONAL EXERCISE APPARATUS

(71) Applicant: Alfred C. Engelfried, Jr., Glendale, CA (US)

(72) Inventor: Alfred C. Engelfried, Jr., Glendale, CA (US)

( * ) Notice: Subject to any disclaimer, the term of this patent is extended or adjusted under 35 U.S.C. 154(b) by 110 days.

(21) Appl. No.: 15/802,133

(22) Filed: Nov. 2, 2017

(65) Prior Publication Data

US 2018/0117396 A1 May 3, 2018

Related U.S. Application Data

(60) Provisional application No. 62/416,579, filed on Nov. 2, 2016.

(51) Int. Cl.
*A63B 23/035* (2006.01)
*A63B 21/00* (2006.01)
(Continued)

(52) U.S. Cl.
CPC ..... *A63B 23/0355* (2013.01); *A63B 5/16* (2013.01); *A63B 21/0023* (2013.01);
(Continued)

(58) Field of Classification Search
CPC .... A63B 5/00; A63B 5/16; A63B 6/00; A63B 21/0004; A63B 21/00058; A63B 21/00061; A63B 21/00065; A63B 21/00069; A63B 21/00072; A63B 21/00076; A63B 21/00178; A63B 21/00185; A63B 21/002; A63B 21/0023; A63B 21/02; A63B 21/06; A63B 21/01; A63B 21/0602; A63B 21/0603; A63B 21/0618; A63B 21/065; A63B 21/068; A63B 21/08; A63B 21/15; A63B 21/151; A63B 21/159; A63B 21/16; A63B 21/4009; A63B 21/4023; A63B 21/4025; A63B 21/4027; A63B 21/4029; A63B 21/4033; A63B 21/4034; A63B 21/4035; A63B 21/4037; A63B 21/4039; A63B 21/4041; A63B 21/4043;
(Continued)

(56) References Cited

U.S. PATENT DOCUMENTS 3,339,920 A * 9/1967 Moritz ..... A63B 9/00 482/34
4,018,442 A * 4/1977 Galler ..... A63B 21/0724 482/106
(Continued)

FOREIGN PATENT DOCUMENTS

CN 104941110 A 9/2015
WO 2014-102542 A1 7/2014

*Primary Examiner* — Gary D Urbiel Goldner
(74) *Attorney, Agent, or Firm* — Polsinelli PC

(57) ABSTRACT

A durable and impact-resistant exercise apparatus that is portable, modular, stackable, and weight-adjustable to allow a user to perform a variety of isolated lower body, core, and upper body resistance training exercises as well as full-body strength training exercises to improve a fitness of the user. The exercise apparatus is configured both as a platform for supporting the user during a first plurality of exercises as well as a weighted body for being lifted or moved by the user during a second plurality of exercises.

20 Claims, 16 Drawing Sheets

(51) Int. Cl.

| | |
|---|---|
| ***A63B 21/072*** | (2006.01) |
| ***A63B 23/04*** | (2006.01) |
| ***A63B 23/12*** | (2006.01) |
| ***A63B 21/06*** | (2006.01) |
| ***A63B 21/055*** | (2006.01) |
| ***A63B 5/16*** | (2006.01) |
| ***A63B 21/002*** | (2006.01) |
| ***A63B 21/08*** | (2006.01) |
| ***A63B 23/02*** | (2006.01) |
| ***A63B 21/04*** | (2006.01) |

(52) U.S. Cl.
CPC ..... *A63B 21/0414* (2013.01); *A63B 21/0557* (2013.01); *A63B 21/0602* (2013.01); *A63B 21/0603* (2013.01); *A63B 21/0618* (2013.01); *A63B 21/072* (2013.01); *A63B 21/08* (2013.01); *A63B 21/15* (2013.01); *A63B 21/4009* (2015.10); *A63B 21/4034* (2015.10); *A63B 21/4035* (2015.10); *A63B 21/4039* (2015.10); *A63B 21/4043* (2015.10); *A63B 23/02* (2013.01); *A63B 23/0405* (2013.01); *A63B 23/047* (2013.01); *A63B 23/1209* (2013.01); *A63B 23/1236* (2013.01); *A63B 2208/0204* (2013.01); *A63B 2208/0219* (2013.01); *A63B 2208/0252* (2013.01); *A63B 2209/00* (2013.01); *A63B 2209/02* (2013.01); *A63B 2210/50* (2013.01); *A63B 2225/09* (2013.01)

(58) Field of Classification Search
CPC . A63B 23/02; A63B 23/0205; A63B 23/0211; A63B 23/0216; A63B 23/0222; A63B 23/035; A63B 23/03508; A63B 23/03516; A63B 23/03525; A63B 23/0355; A63B 23/04; A63B 23/0405; A63B 23/0458; A63B 23/047; A63B 23/0482; A63B 23/0488; A63B 23/0494; A63B 23/12; A63B 23/1209; A63B 23/1227; A63B 23/1236; A63B 23/1245; A63B 23/1281; A63B 2023/0411; A63B 26/00; A63B 26/003; A63B 2209/00; A63B 2209/02; A63B 2209/023; A63B 2210/00; A63B 2210/50; A63B 2210/58; A63B 2225/09; A63B 2225/093; A63B 2244/09; A63B 3/00; A63B 9/00; A63B 2009/006; A63B 17/00; A63B 17/02; A63B 17/04
See application file for complete search history.

(56) References Cited

U.S. PATENT DOCUMENTS

| | | | | | |
|---|---|---|---|---|---|
| 4,630,819 | A * | 12/1986 | Levin | A63B 9/00 | 182/118 |
| 4,773,639 | A * | 9/1988 | Graves | A47D 13/04 | 297/5 |
| 4,863,163 | A | 9/1989 | Wehrell | | |
| 5,551,934 | A | 9/1996 | Binette | | |
| 5,716,305 | A * | 2/1998 | Selsam | A63B 21/00047 | 482/106 |
| 5,842,960 | A * | 12/1998 | Yu | A63B 23/0488 | 482/131 |
| 5,891,003 | A * | 4/1999 | Deac | A63B 5/16 | 482/106 |
| 6,280,364 | B1 * | 8/2001 | Deac | A63B 5/16 | 482/106 |
| 6,390,959 | B1 | 5/2002 | Tornabene et al. | | |
| 6,634,998 | B2 | 10/2003 | Siaperas | | |
| 6,679,815 | B2 | 1/2004 | Vittone et al. | | |
| 7,294,100 | B2 | 11/2007 | Bull | | |
| 7,494,453 | B2 | 2/2009 | Wehrell | | |
| 7,591,763 | B1 | 9/2009 | Fucci | | |
| 8,033,966 | B2 | 10/2011 | Ayoub | | |
| 8,337,372 | B1 * | 12/2012 | Boterenbrood | A01B 1/02 | 294/49 |
| 8,721,507 | B2 | 5/2014 | Blancher | | |
| 8,998,778 | B2 | 4/2015 | Potts et al. | | |
| 9,022,911 | B2 * | 5/2015 | Goldberg | A63B 21/04 | 482/123 |
| 2002/0160891 | A1 | 10/2002 | Gallagher | | |
| 2003/0004042 | A1 * | 1/2003 | Burrell | A63B 21/00047 | 482/121 |
| 2006/0122043 | A1 * | 6/2006 | Van Straaten | A63B 21/055 | 482/121 |
| 2010/0048363 | A1 * | 2/2010 | Gilberti | A63B 21/0603 | 482/105 |
| 2014/0274571 | A1 * | 9/2014 | Aral Diaz | A63B 17/00 | 482/37 |
| 2016/0008654 | A1 * | 1/2016 | Kalisz | A63B 21/4043 | 482/93 |
| 2016/0016029 | A1 | 1/2016 | Savioli | | |

* cited by examiner

MULTI-FUNCTIONAL EXERCISE APPARATUS

CROSS-REFERENCE TO RELATED APPLICATIONS

This application is related to and claims priority under 35 U.S.C. § 119(e) to U.S. Patent Application Ser. No. 62/416,579, filed Nov. 2, 2016 entitled "MULTI-FUNCTIONAL EXERCISE APPARATUS", the entire contents of which is incorporated herein by reference for all purposes.

FIELD

The present disclosure generally relates to portable and multi-functional exercise apparatuses or equipment to be used to perform multiple exercises of various types to strengthen and condition multiple muscle groups.

SUMMARY

Briefly described, one embodiment of the multi-functional exercise apparatus of the present disclosure comprises an elongate body having a length along a longitudinal axis between end walls, a width along a transverse axis between sidewalls, and a thickness between a first surface and a second surface, with the first and second surfaces being substantially planar across a center portion of the elongate body. A central aperture is formed through the thickness of the elongate body at the center of the first and second surfaces, with the central aperture having an aperture length between aperture ends that is sufficient to accommodate a shoulder width of the user, and an aperture width between aperture sides that is sufficient to accommodate a chest-to-back thickness of the user. The elongate body also includes a handle at each aperture end that is configured for gripping by the hands of the user, and one or more empty volumes formed between each aperture end and an adjacent end wall of the elongate body, and which empty volume is configured to removably receive an additional mass for increasing the weight of the elongate body. The elongate body is formed from a resilient and impact resistant material and includes an inner frame made from a metallic or similar rigid material that provides structural support.

Another embodiment of the present disclosure comprises an elongate body having a length along a longitudinal axis between end walls, a width along a transverse axis between sidewalls, and a thickness between a first surface and a second surface, with the first and second surfaces being substantially planar across a center portion of the elongate body. A central aperture is formed through the thickness of the elongate body at the center of the first and second surfaces, with the central aperture having an aperture length between aperture ends that is sufficient to accommodate a shoulder width of the user, and an aperture width between aperture sides that is sufficient to accommodate a chest-to-back thickness of the user. The elongate body also includes a handle at each aperture end that is configured for gripping by the hands of the user. In addition, the elongate body is configurable both as a platform for supporting the user during a first plurality of exercises as well as a weighted body for being lifted or moved by the user during a second plurality of exercises.

The disclosure will be better understood upon review of the detailed description set forth below taken in conjunction with the accompanying drawing figures, which are briefly described as follows.

Those skilled in the art will appreciate and understand that, according to common practice, various features and elements of the drawings described above are not necessarily drawn to scale, and that the dimensions of the various features and elements may be expanded or reduced to more clearly illustrate the embodiments of the present disclosure described therein.

DETAILED DESCRIPTION

The following description, in conjunction with the accompanying drawings described above, is provided as an enabling teaching of exemplary embodiments of a portable, multi-functional exercise apparatus and one or more methods for using the exercise apparatus to perform a variety of isolated lower body, core, and upper body resistance training exercises, as well as full-body strength training exercises, to improve the fitness of a user. As described below, the exercise apparatus can provide several significant advantages and benefits over other single-function and multi-functional portable exercise apparatuses available in the art. However, the recited advantages are not meant to be limiting in any way, as one skilled in the art will appreciate that other advantages may also be realized upon practicing the present disclosure.

Furthermore, those skilled in the relevant art will also recognize that changes can be made to the described embodiments while still obtaining the beneficial results. It will further be apparent that some of the advantages and benefits of the described embodiments can be obtained by selecting some of the features of the embodiments without utilizing other features, and that features from one embodiment may be combined with features from other embodiments in any appropriate combination. For example, any individual or collective features of method embodiments may be applied to apparatus, product or system embodiments, and vice versa. Accordingly, those who work in the art will recognize that many modifications and adaptations to the embodiments described are possible and may even be desirable in certain circumstances, and are a part of the disclosure. Thus, the present disclosure is provided as an illustration of the principles of the embodiments and not in limitation thereof, since the scope of the invention is to be defined by the claims.

Figure 1:
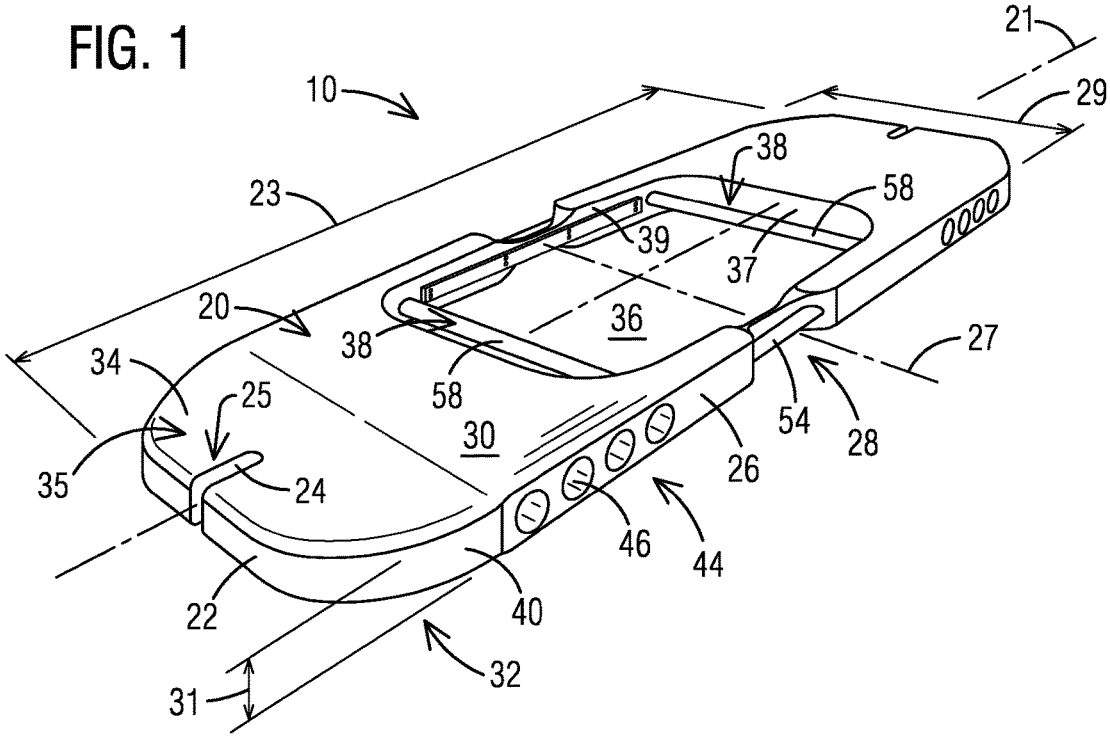
FIG. 1 is a perspective view of a multi-functional exercise apparatus, in accordance with a representative embodiment of the present disclosure.
Figure 2:
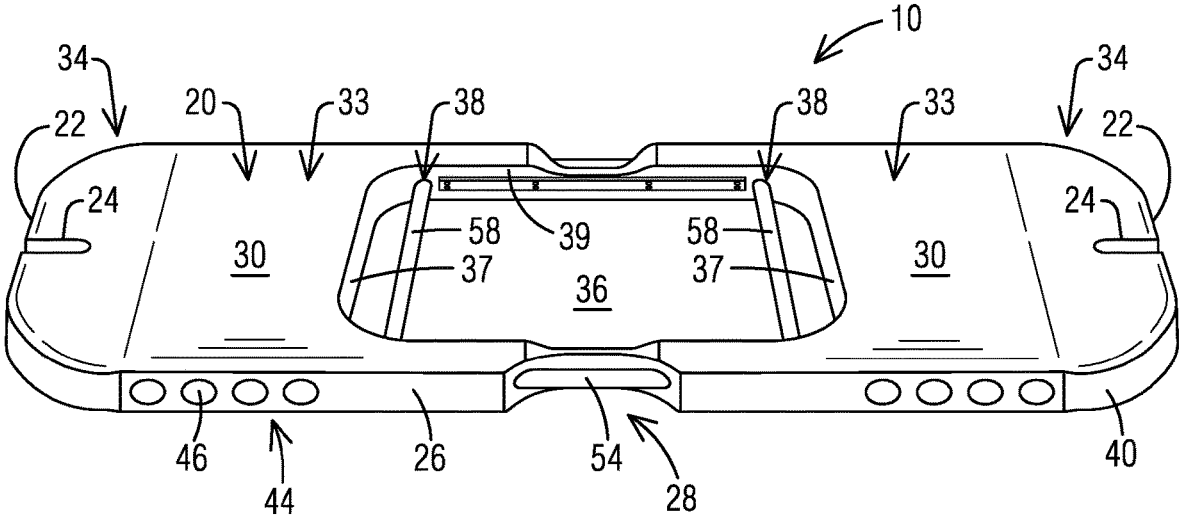
FIG. 2 is a side perspective view of the exercise apparatus of FIG. 1.

Referring now in more detail to the drawing figures, wherein like parts are identified with like reference numerals throughout the several views, FIGS. 1-2 illustrate one embodiment of the portable and multi-functional exercise apparatus 10 that can be used to perform a variety of isolated lower body, core, and upper body resistance training exercises, as well as full-body strength training exercises, to improve the fitness of a user. The exercise apparatus 10 generally comprises a flat, elongate, and bilaterally symmetrical platform, also referred to as an elongate body 20, with curved end portions 34. The elongate body 20 has a length 23 along a longitudinal axis 21 between end walls 22, a width 29 along a transverse axis 27 between sidewalls 26, and a thickness 31 between a first or upper surface 30 and a second or lower surface 32, with both the upper surface 30 and the lower surface 32 being substantially planar across a center portion of the elongate body. In one exemplary embodiment the elongate body 20 can have a length of about 60 inches, a width of about 30 inches, and a thickness that can generally range 3 inch between 3 inches and 6 inches. Nevertheless, the elongate body can be formed in a variety of sizes and weights, and can be extended or shortened or otherwise modified to accommodate users of different size, with different physical capabilities, and the like. In addition, the elongate body 20 can be bilaterally symmetric around the transverse axis 27, so that either of the first surface 30 and the second surface 32 can be on top, and either end wall 22 can be on the left side or on the right side of a user positioned near the center of the exercise apparatus.

Figure 7:
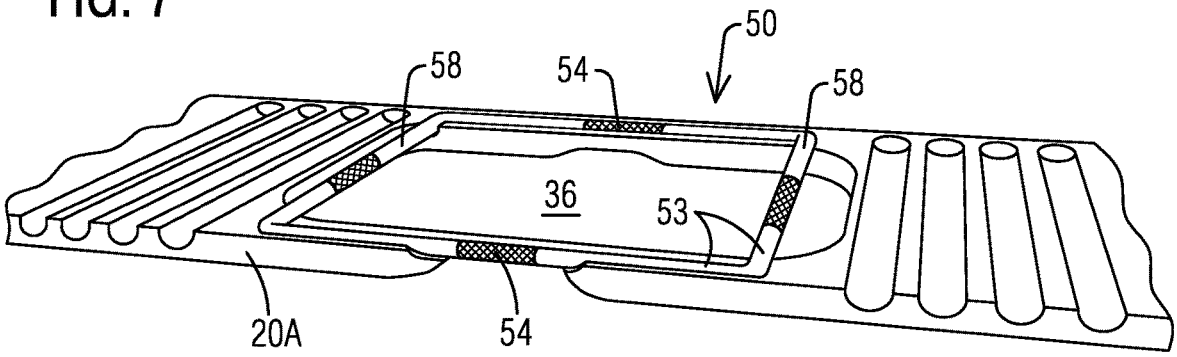
FIG. 7 is a side perspective view of the exercise apparatus of FIG. 1 during construction showing the inner frame.

The elongate body 20 of the exercise apparatus 10 can be formed from a resilient and impact resistant material 40, such as a hard rubber composite, a Kevlar™ composite, a plastic composite, a fiberglass composite, wood, and the like that absorbs and dissipates shock without permanent deformation or damage to the material 40. In some embodiments the impact resistant material can comprise a combination of materials, such as a layered combination of different resilient materials having different coefficients for stiffness and damping, and can include one or more coatings that affect the hardness, durability, and/or finish of the exposed surfaces. In one aspect the resilient and impact resistant material 40 can be substantially solid through the thickness 31 of the elongate body 20 thereof, except for a rigid inner structural skeleton or frame 50 (FIG. 7), a central aperture 36, and a variety of voids 44 such as smaller side chambers 46 or enclosed empty volumes that are configured to receive additional mass for increasing the weight of the elongate body, as will be discussed in more detail below. This durable construction of a rigid inner frame 50 embedded within a substantially solid but resilient and impact resistant shock-absorbing material 40 can allow for the elongate body 20 of the exercise apparatus 10 to be repeatedly flipped, dragged, pushed, pulled, lifted, carried, dropped, and slammed during normal use without damage to the exterior surface or internal structures of the elongate body.

The rigid inner frame 50 can be made from a metallic material 52 such as steel alloy or aluminum alloy, as well as carbon fiber, a structural plastic, or similar non-metallic rigid material. When made from metallic materials, moreover, the rigid inner frame can further comprise individual tubes or bars 30 that have been welded, bent, glued, bonded, or otherwise fastened together to form the inner frame 50 prior to being installed into or embedded within the elongate body 20, depending on the method of construction. For example, as shown in the partially assembled view of the elongate body provided in FIG. 7, in some embodiments the inner frame 50 can comprise tubes 53 or rods made from steel 52 that have been welded together at their corners to form a rectangular frame 50 or skeleton that fits within notches or grooves formed into the lower half 20(A) of the elongate body, and with complimentary structure formed into the upper half (not shown) of the elongate body. In embodiments that include solid rods, moreover, the rods can be round or square and can be machined or otherwise shaped and/or textured in predetermined sections to form handles that can be readily grasped by a user. In this way the inner frame 50 can be strategically positioned within the elongate body to provide additional strength and support in the thinner portions of the elongate body 20 surrounding the central aperture 36, and to readily transfer applied forces into the resilient and shock absorbing material 40 that forms the elongate body. Thus, it will be appreciated that the steel frame 50 or skeleton can provide structure and weight to the exercise device 10, as well as two different sets of handles 54, 58 for griping and holding the elongate body during a variety of exercises.

The central aperture 36 is formed through the thickness 31 of the elongate body at the center of the first and second surfaces, and with an aperture length between aperture ends 37 that is sufficient to accommodate the shoulder width of a user, and an aperture width between aperture sides 39 that is sufficient to accommodate a chest-to-back thickness of the user. This can allow the user to position herself within the central aperture 36 when performing one or more exercises. In one aspect, the width of the central aperture between aperture sides 39 can be 22 or more inches, and with aperture length between aperture ends 37 being more than the aperture width. In addition, handles 38 can be included at each aperture end 37 that allow the user to grip, hold, and lift the elongate body 20 when performing exercises. In one aspect, the handles 38 can comprise exposed portions of the inner frame 50, such as the tubular steel bars 53 described above, that extend across with the width of the aperture 36 near the ends 37, and that can be textured with diamond-patterned knurling or rubberized and the like for better grip.

In yet another embodiment the elongate body 20 of the exercise apparatus 10 can have a substantially solid-body construction. For example, the elongate body 20 may comprise a base body made of a plastic material formed in a mold, of a wooden material milled out of a solid block of wood, of a lightweight metallic material, such as aluminum, machined from a block of metal or even 3-D printed, and the like. The substantially solid base body can then be coated with a resilient and impact resistant material that absorbs and dissipates shock without permanent deformation or damage to the elongate body 20. In this embodiment the elongate body 20 may not include a separate rigid inner frame, as shown the drawings, and instead the various handles can be formed integral with the main sections of the elongate body or may be separable components that are attachable to the elongate body 20 with fasteners.

As discussed above, both the upper surface 30 and the lower surface 32 of the elongate body 20 can be substantially planar across the center portion of the elongate body 20 to provide a flat and level surface that allows for a user to stand on the elongate body, and for multiple elongate bodies to be stacked one on top the other for storage. The central planar portions of the upper and lower surfaces 30, 32 generally have a durable but smooth finish 33 so that the elongate body 20 can easily slide across a ground surface, such as grass, sand or a gym floor.

Both of the upper surface 30 and the lower surface 32, moreover, can include curved end portions 34 with rounded edges that arc inwardly with a convex curve to end walls 22 having substantially flat surfaces that are perpendicular to the planar portions of the upper and lower surfaces 30, 32, and that can support the elongate body 20 in an upright position. In addition, the curved end portions 34 can have a textured surface finish 35 that provides a gripping surface for a user's hands, thereby enabling the flipping of the elongate body 20 by rocking one end of the elongate body into the vertical position on its end and allowing it to drop over onto its opposite flat surface. In one aspect the end walls 22 can have a height that is less than two-thirds or even less than one-half the thickness 31 of the elongate body 20, so as to provide a narrow flat peak that can provide the elongate body 20 with a distinguishing "chisel" shape as well as facilitate the tire flipping exercise. In an alternative embodiment (not shown) the end walls may not comprise a flat surface, and instead may be continuously curved around the ends of the elongate body 20.

In addition, in some embodiments the sidewalls 26 of the elongate body 20 can also curved inwardly with a convex curve toward the substantially flat surfaces of the end walls 22, so as to reduce the width of the end walls 22 to less than or about two-thirds the width 29 of the elongate body. This feature can limit the surface area of the supporting end wall surfaces 22 as the elongate body 20 is rotated upward toward the vertical upright position, thereby requiring a user to apply more core-engaging lateral forces to stabilize the elongate body during the flipping exercise, thereby leading to a more complete activation of the user's various muscle groups.

Figure 20:
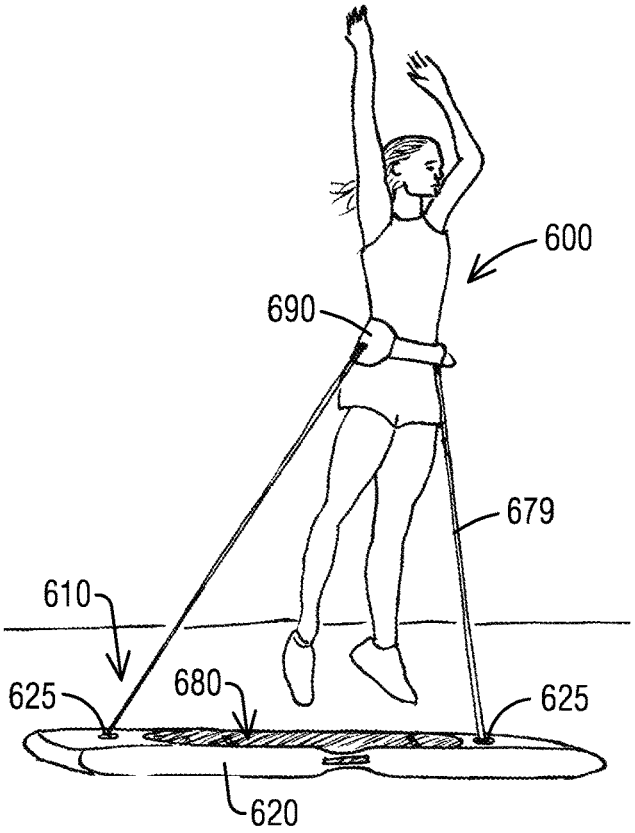
FIG. 20 is a schematic drawing of an athlete using the exercise apparatus as a platform to perform a plyometric jumping exercise with elastic resistance.
Figure 29:
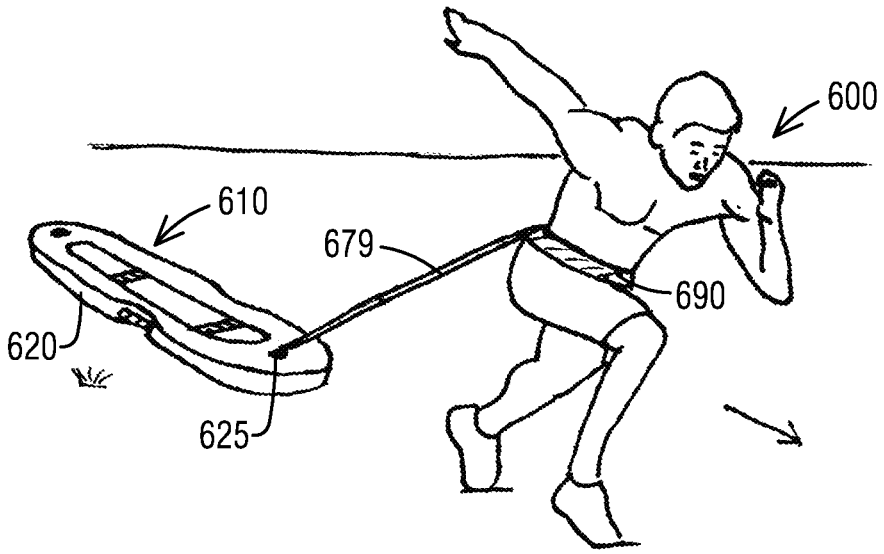
FIG. 29 is a schematic drawing of an athlete using the exercise apparatus as a weighted body to perform a sled drag exercise.
Figure 30:
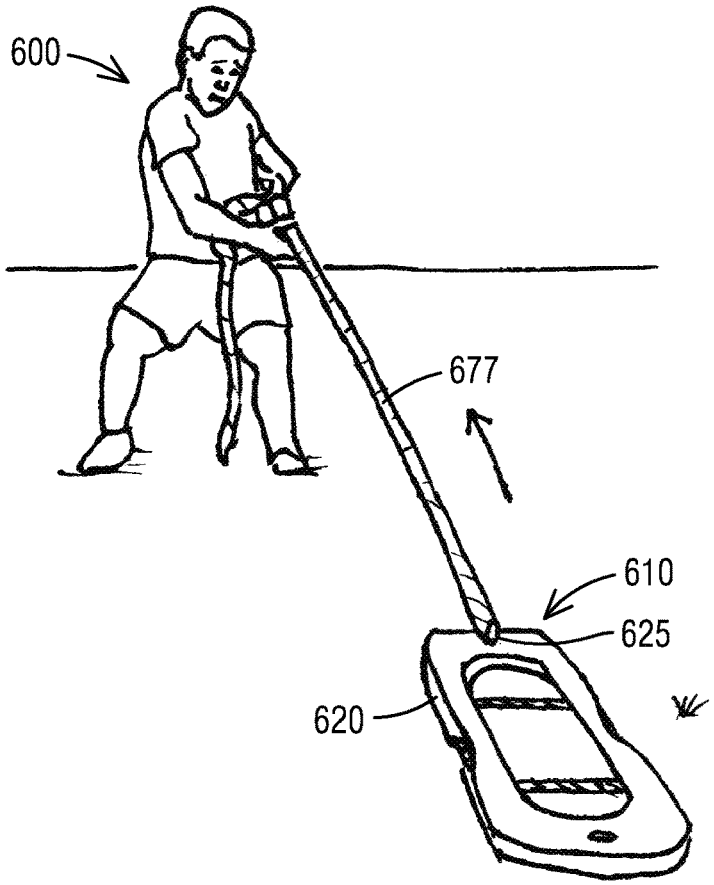
FIG. 30 is a schematic drawing of an athlete using the exercise apparatus as a weighted body to perform a sled pull exercise.

In some embodiments of the exercise apparatus 10 a notch or slot 24 can be formed into the center of each end wall 22 and extend inwardly into the curved end portions 34 for a predetermined distance to expose a carabiner or rope anchor 25, such as a post or pin, that is positioned within the slot and accessible from both the first and second surfaces 30, 32 of the elongate body. As illustrated in FIGS. 20 and 29-30 below, the anchors 25 can serve as attachment locations for ropes or straps, as well as carabiners that are in turn coupled to bungees, heavy ropes, harnesses, and resistance bands, and the like, that can be coupled to the elongate body 20 for specific exercises.

Also shown in FIGS. 1-2, the elongate body 20 may include one or more voids 44 or empty volumes formed into the portion of the elongate body between each aperture end 37 and an adjacent end wall 22 of the elongate body, and which are configured to removably receive an additional mass for increasing the weight of the elongate body, and/or alter the weight distribution depending on which empty volume or volumes to which weight is applied. In the embodiment of the exercise apparatus 10 shown in FIGS. 1-2, for example, the voids 44 can comprise a plurality of side chambers 46 extending parallel to the transverse axis 27 of the elongate body 20 and opening from a sidewall 26, and which are configured for receiving a weighted insert having a known mass.

Figure 3:
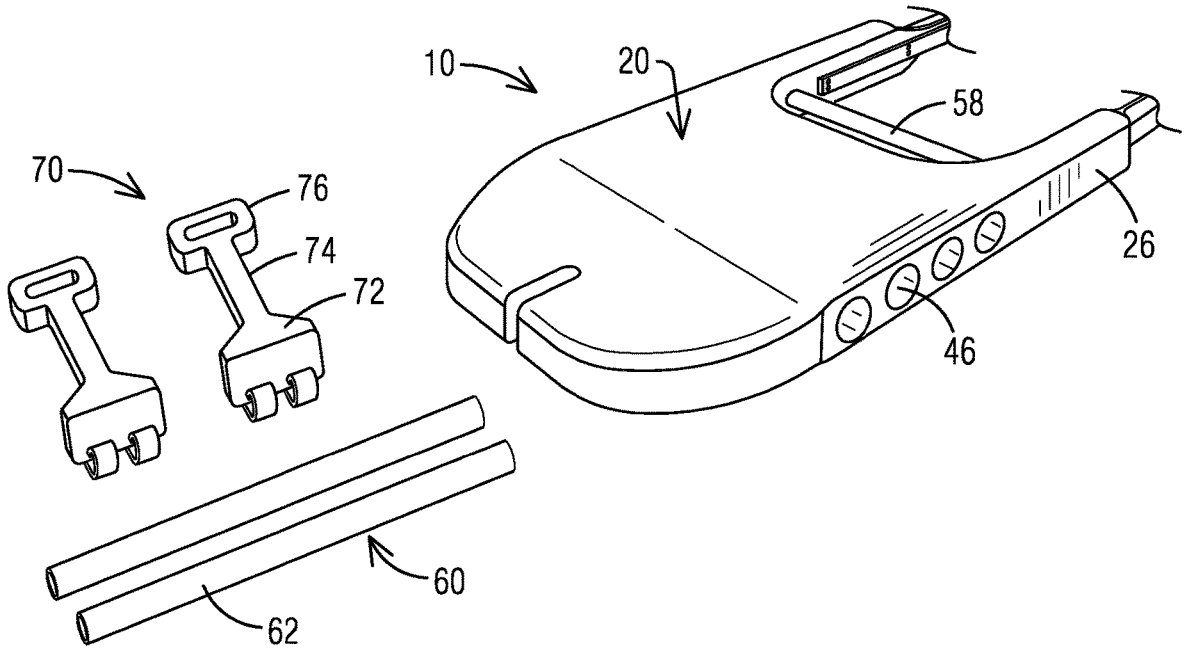
FIG. 3 is a perspective view of one end of the exercise apparatus of FIG. 1 with a set of separately attachable weighted inserts and separately attachable risers.
Figure 9:
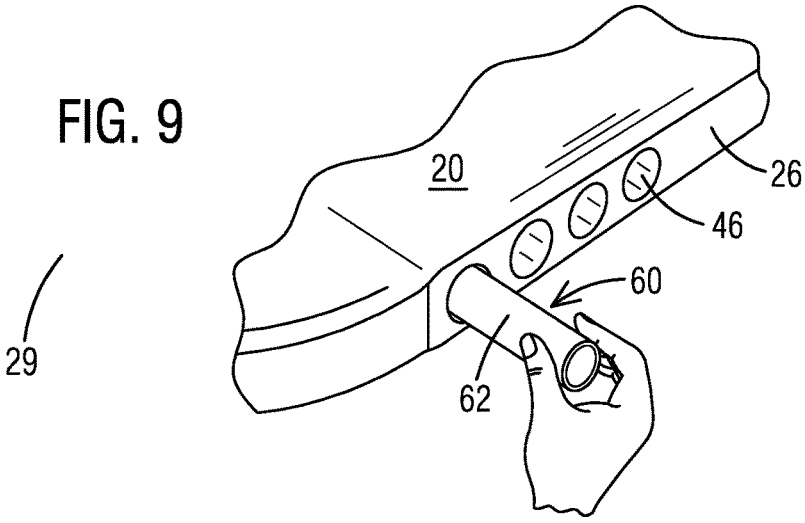
FIG. 9 is a close-up view of a weighted inserts being installed into a side chamber formed into the exercise apparatus of FIG. 1.

FIG. 3 is a perspective view of one end of the elongate body 20 of the exercise apparatus 10 with a pair of separately attachable weighted inserts 60 and with a pair separately attachable risers 70. As shown in FIGS. 3 and 9, in one aspect the weighted inserts 60 can further comprise hollow steel tubes 62 or rods that can slide into the side chambers 46 to add variable weight to each side of the elongate body 20. Other options for the weighted inserts 60 include heavy rubber rods, as well as hollow metallic tubes filled with sand or water (see FIG. 13 below). The steel tubes 62 or weighted inserts 60 can be secured within the side chambers 46 using a variety of locking mechanisms, including but not limited to friction fit, screw locks, key locks, spring pin locks, internal spring clamps, elliptical friction rods, magnetic or electro-magnetic locks, latch pins, locking pins, swing plate door locks, sliding compartment doors, collars, and the like. Depending on the method of securing the weighted insert 60 within the side chamber 46, the side chamber can be closed at one end or can extend all the way through the width of the elongate body 20 from sidewall 26 to sidewall 26. As will be appreciated by one of skill in the art, the additional mass provided by the weighted inserts 60 can be used increase the stability to the exercise apparatus 10 when used as a platform (such as FIGS. 20-26), as well as to vary the weight resistance provided by the exercise apparatus 10 when used in exercises involving a weighted body (such as FIGS. 28-38).

It will be appreciated that the weighted inserts 60 could also be provided in a variety of cross-sectional shapes other than circular, including but not limited to square, rectangular, triangular, oblong or elliptical, and the like, for insertion into side chambers 46 having a complimentary-shaped profile. In addition, the shape of the weighted inserts 60 may not be straight (e.g. the inserts could have an arcuate shape along the length thereof) or may not be elongate (e.g. the inserts could have a more cubic or disc-shaped body), and may also vary along the length thereof. Moreover, it is further contemplated that the voids 44 for receiving and holding the weighted inserts 60 during exercise may be accessible from either the upper surface 30 or the lower surface 32, or even from the end walls 22.

Figure 4:
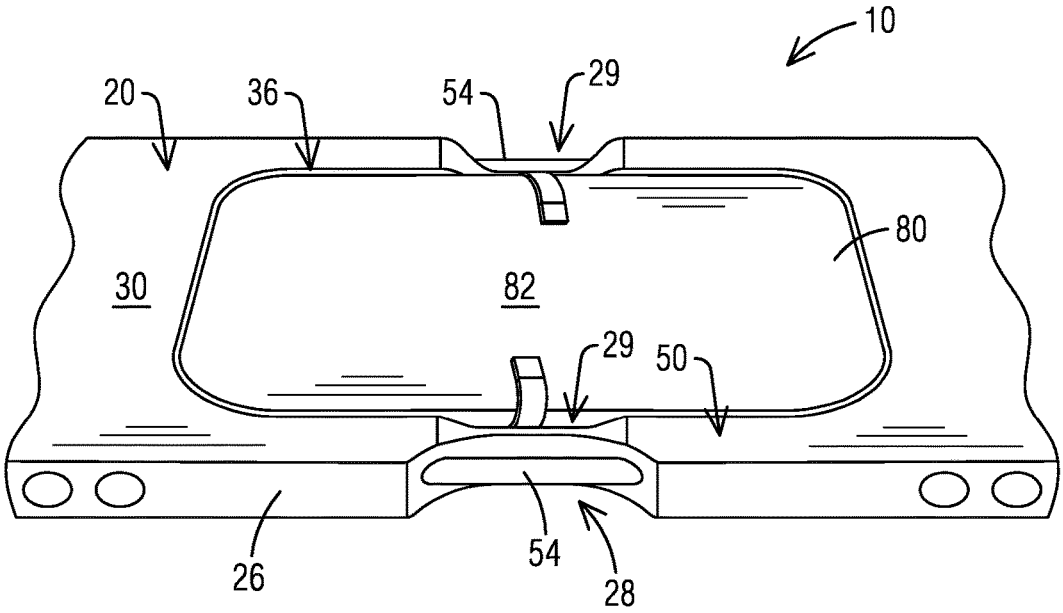
FIG. 4 is a close-up side perspective view of the center portion of the exercise apparatus of FIG. 1 with a separately attachable platform insert.
Figure 8:
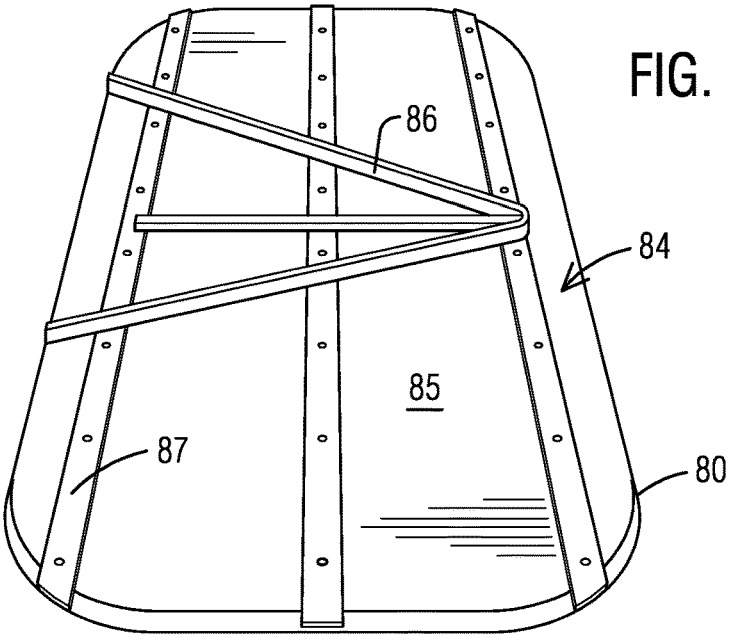
FIG. 8 is a close-up view of the underside of the separately attachable platform insert, in accordance with another representative embodiment.

FIG. 4 is a close-up side perspective view of the center portion of the elongate body 20 of the exercise apparatus 10 with a separately attachable platform insert 80 being secured within the center aperture 36 and supported on the aperture handles 58, so as to provide a continuous support surface across the length and width of top surface of the elongate body 20. In one aspect the top surface 82 of the platform insert 80 can be flush with the top surface 30 of the elongate body 20. With additional reference to FIG. 8 that shows the underside 84 of the platform insert 80, the platform insert can include a reinforced under-plate 85 that is constructed of steel, aluminum, Kevlar™, fiberglass. or similar stiff material, and which can support substantial pressure by transferring a load applied to the top surface 82 through the elongate body of the platform insert 80 to the aperture handles 58 that straddle the opening and that serve, in turn, to transfer to the load through the internal frame 50 to the shock-absorbing material 40 of the elongate body 20. The top surface 82 of the platform insert 80 can be padded for comfort and shock absorption. In this way the user or athlete can jump, kneel, lie, sit, stand, etc. on the top surface of the exercise apparatus 10 once the platform insert 80 has been installed. In some embodiment the underside 84 of the platform insert can include additional bracing 86 in the unsupported center portion for reducing deflection, and lateral supports 87 for transferring the load away from the center portion to the aperture handles 58.

Also shown in FIG. 4 are side notches 28 formed into the sidewalls 26 of the elongate body 20 at the transverse axis 27, and that curve inwardly to expose a sufficient portion of the rigid inner frame 50 to provide side handles 54 for a user to grip and carry the elongate body 20.

Figure 5:
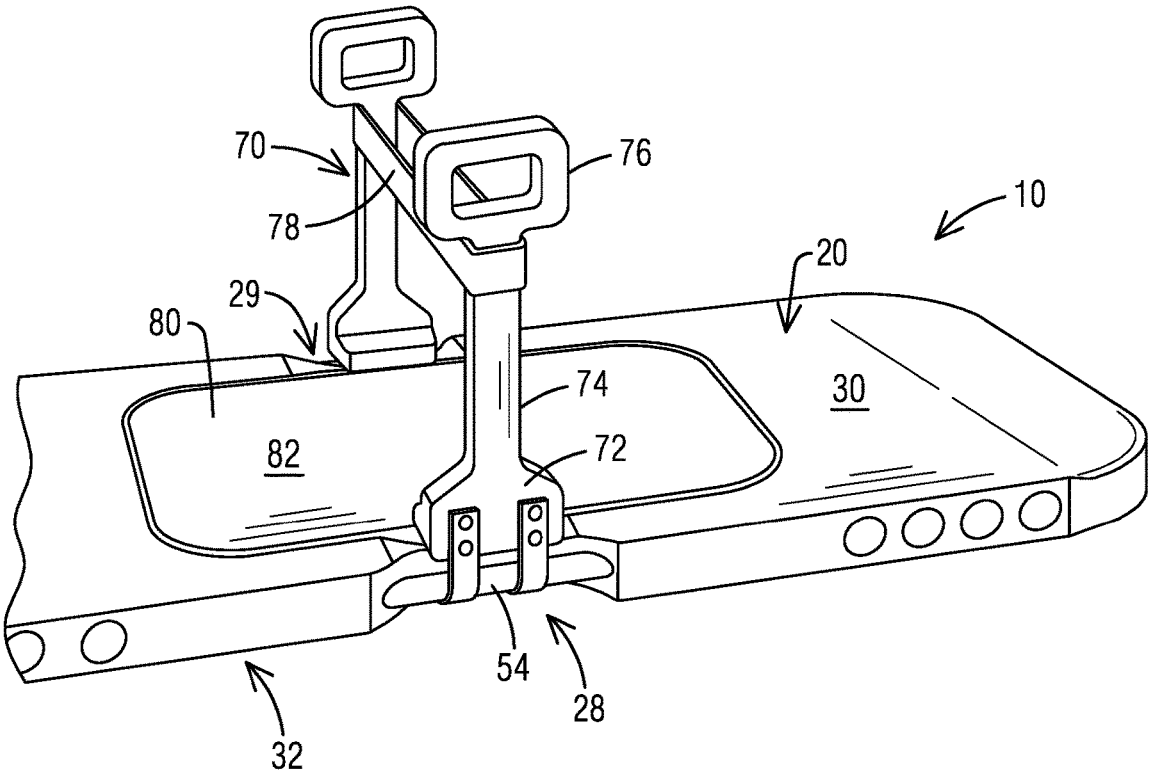
FIG. 5 is a close-up side perspective view of the exercise apparatus of FIG. 1 with the risers being attached to the side handles and a resistance band extending between the risers.
Figure 6:
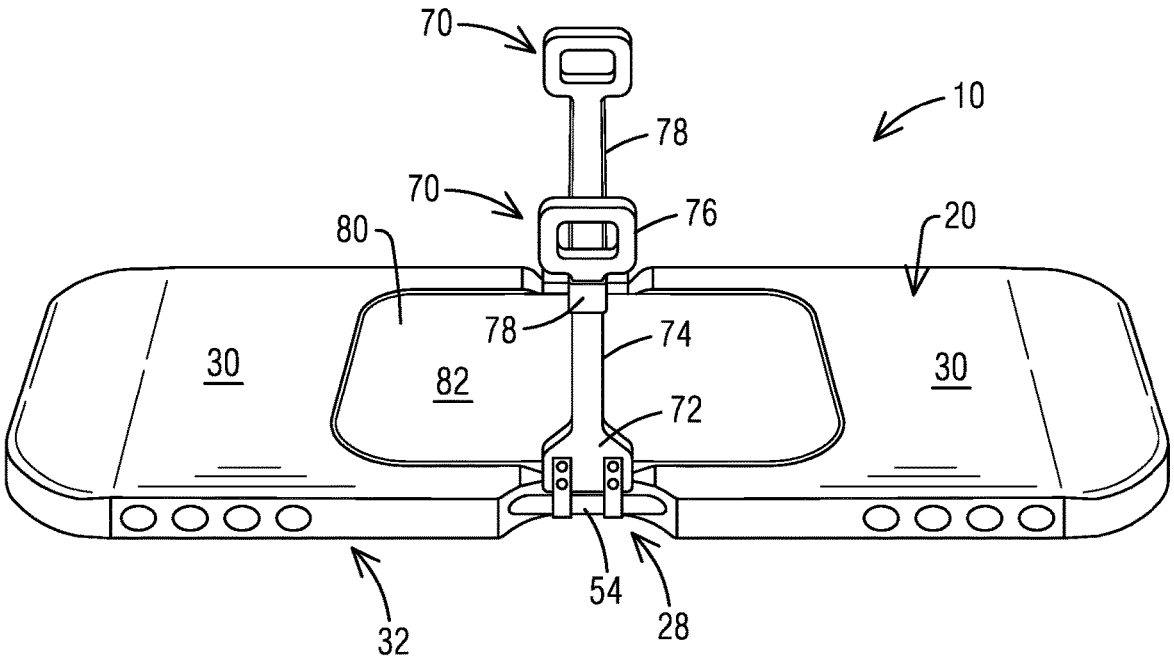
FIG. 6 is a side perspective view of the exercise apparatus of FIG. 1 with the risers being attached to the side handles and a resistance band extending between the risers.

Besides providing additional handgrips, the side handles 58 and the adjacent surfaces 29 of the side notches 28 can together provide an attachment structure for securely coupling or clamping the base portions 72 of the risers 70 (FIG. 3) to the elongate body 20, as further depicted in FIGS. 5-6. For instance, the base portions 72 of the risers 70 can include hooks or clamps that secure around the side handle as the outer surface of the riser becomes wedged or pressed against the adjacent surfaces 29 of the side notch 28. In other embodiments (not shown) the risers can be secured to the elongate body 20 with hinges and folded to stow-away within the elongate body when not in use. In yet other embodiments (FIGS. 15-16) the risers can be fixed together with a crossbeam that extends across the center aperture when installed.

When coupled to the elongate body 20 in a horizontal orientation, the risers 70 can extend upward and out-of-plane to the top surfaces 30, 82 of the elongate body 20 and the platform insert 80, respectively, from the base portion 72 of the riser 70 through a necked center portion 74 to a handle or an upper grip portion 76. After the mounting or coupling of the risers 70 to the elongate body 20 an elastic or stretchable resistance band 78 can be secured to either the center portions 74 or the grip portions 76 of both risers 70 to span the space above the platform insert 80. The resistance band 78 can then be used to perform a variety of strengthening exercises in which the user is supported on the platform insert 80 while pressing against the resistance band 78 with a portion of their torso or with a limb, including but not limited to the hip, core, and leg strengthening exercises shown in FIGS. 21-26.

Figure 12A:
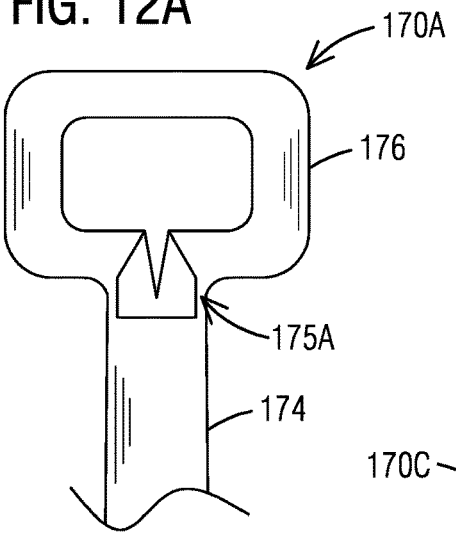
FIGS. 12A-12C are close-up schematic views of tensioning devices that can be used with the multi-functional exercise apparatus, in accordance with additional representative embodiments of the present disclosure.
Figure 12B:
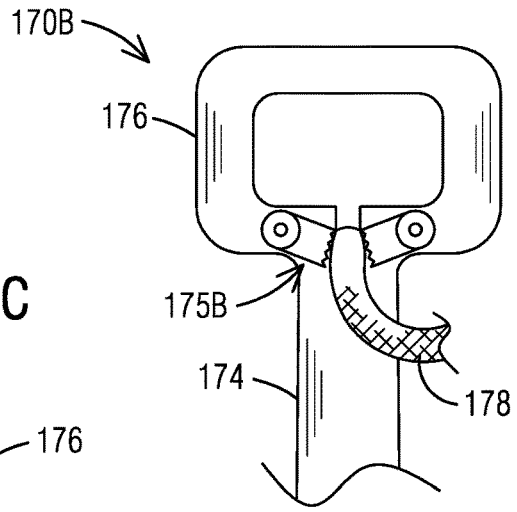
Figure 12C:
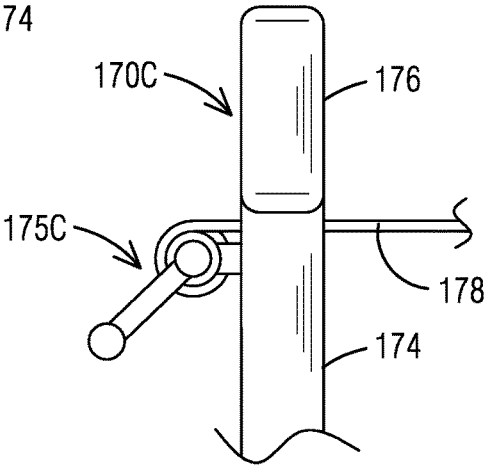

In one aspect of the present disclosure, such as that shown in FIG. 5-6, the elastic resistance band 78 can have looped ends that are stretched open and then released to snap in place round the necked center portion 74 of the risers 70. Alternatively, the resistance band can have straight ends that are wrapped around the riser to secure it in place. In yet other embodiments, such as those shown in FIGS. 12A-12C, one or both of the risers 170A-1700 can include a tensioning mechanism 175A-175C that may be used to increase the tension on the resistance band as it is stretched between the risers 170A-1700, and thereby provide additional or variable resistance to the user of the exercise device. For instance, the tensioning mechanism 175A can be a wedge-shaped slot (FIG. 12A) where the resistance band becomes pinched when pulled into the slot, a winch mechanism 175B (FIG. 12B) that locks the resistance band into place, or a crank mechanism 175C (FIG. 12C) where the resistance band is wrapped onto a ratcheting spool. In addition, the tensioning mechanism(s) can be configured to orient the plane of the resistance band in the vertical and/or horizontal plane(s) of the elongate body 120, as desired, as it extends across the width of the elongate body between the risers 170A-170C.

Figure 10:
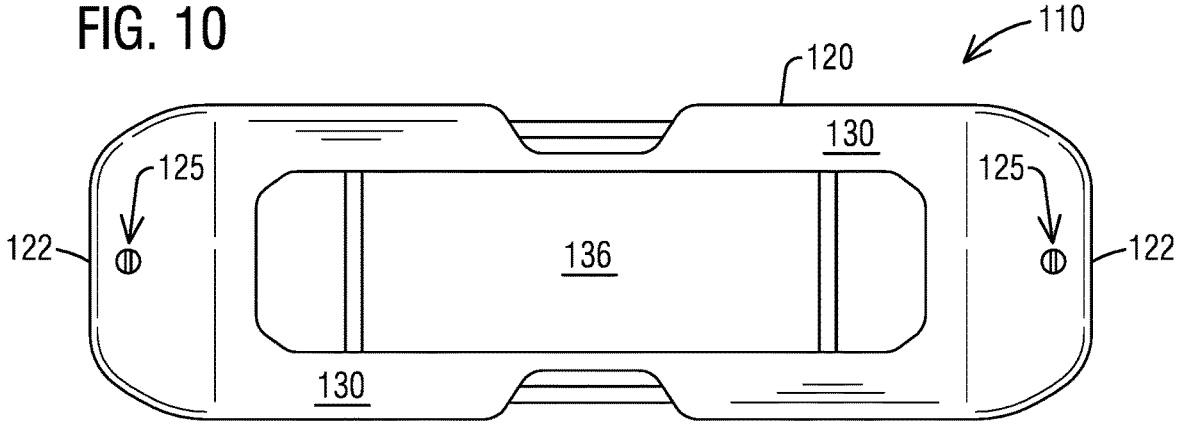
FIG. 10 is a top view of the multi-functional exercise apparatus, in accordance with another representative embodiment of the present disclosure.
Figure 11:
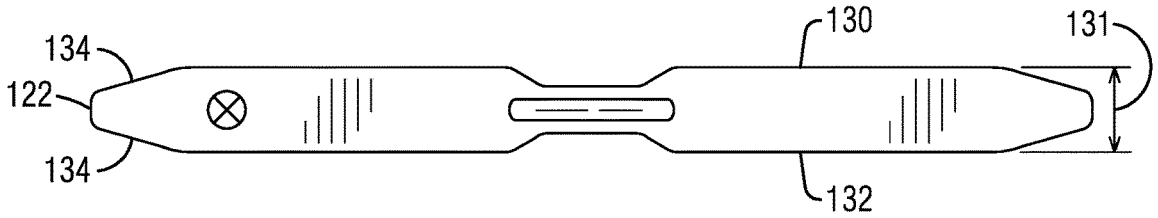
FIG. 11 is a side view of the multi-functional exercise apparatus of FIG. 10.

FIGS. 10 and 11 illustrate another embodiment of the exercise device 110 in which the thickness 131 of the elongate body 120 between the upper or first surface 130 and the lower or second surface 132 can be 5-6 inches or greater. This increased thickness can allow for an increased radius of convex curvature at the curved end portions 134 of the elongate body 130 between the upper and lower surfaces 130, 132 and the end walls 122, and which in turn can facilitate the rocking or rolling the elongate body 120 upward an upright position during a tire flip exercise. The increased curvature at the curved end portions 134 combined with the narrowness of the end walls 22 can, in one aspect, provide the elongate body 120 with an even more distinguishable overall "chisel" shape. Furthermore, as can be seen in FIG. 10, anchors 125 for attaching carabiners to the elongate body 120 can further comprise inset metal clip anchors mounted into both the upper and lower surfaces 130, 132 of the elongate body proximate the end walls 122, with the straps, bungees, heavy ropes, harnesses, resistance bands, and the like, in turn being attached to the carabiners for specific exercises.

Figure 13:
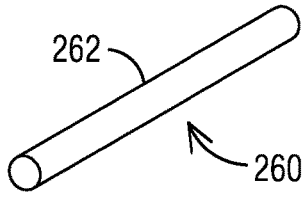
FIG. 13 is a perspective view of weighted insert that can be used with the multi-functional exercise apparatus, in accordance with another representative embodiment of the present disclosure.
Figure 14:
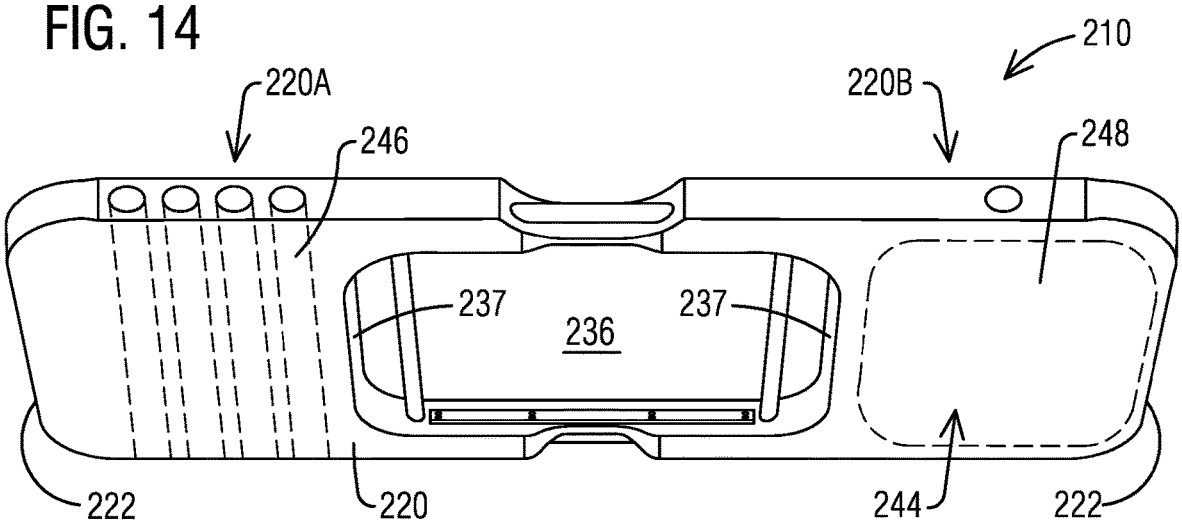
FIG. 14 is an underside perspective view of the multi-functional exercise apparatus configured to receive the weighted insert of FIG. 13, in accordance with another representative embodiment of the present disclosure.

FIGS. 13 and 14 illustrate yet another embodiment of the exercise device 210 in which the removably attached weighted inserts 260 can further comprise sealable tubes 262 partially or fully filled with sand, water or similar fluid-type material, and with one or more of the hollow tubes 262 being inserted into the series of side chambers 246, as depicted at one end 220A of the elongate body. In the alternative, as shown at the opposite end 220B of the elongate body, the empty volume or void 244 between each aperture end 237 and each end wall 222 can comprises a sealable internal tank 248 that can be filled partially or fully with sand or water. In situations where either the sealable tube inserts 262 or the sealable internal tank 248 are only partially filled with sand or water, movement of the elongate body can cause dynamic shifting of the material or fluid within the enclosed volumes 244, thereby challenging the user's core and balance.

When completely filled a fluid-type material such as sand or water, moreover, the additional mass added to an empty tank version 220B of the elongate body can provide for a substantial percentage increase in the overall weight of the elongate body. For example, in some embodiments an elongate body 220B with one or more sealable internal tanks configured to receive up to 12.5 gallons of water can weight 50-60 lbs. when empty, but would provide for an increase in overall weight by an additional 100 lbs. when full.

Figure 15:
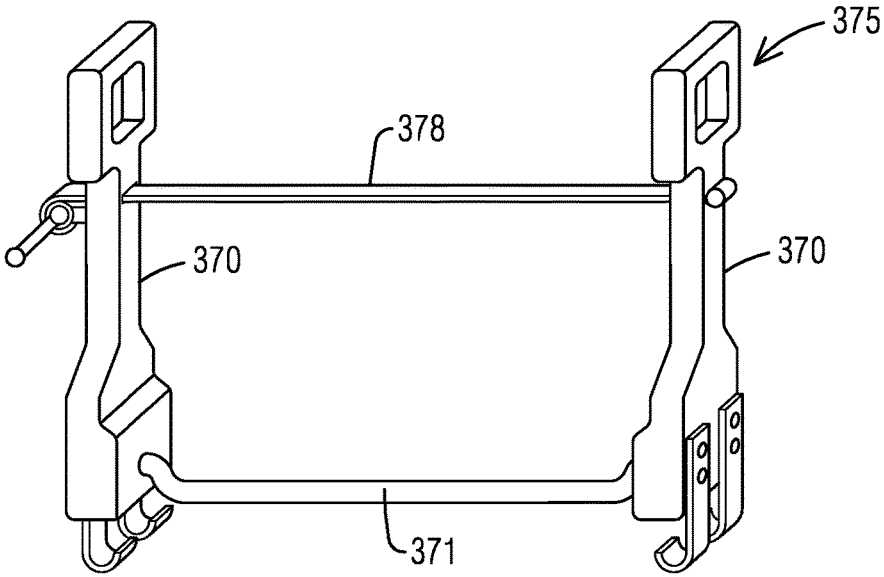
FIG. 15 is a perspective view of a pair of risers combined with a cross beam support that can be used with the multi-functional exercise apparatus, in accordance with another representative embodiment of the present disclosure.
Figure 16:
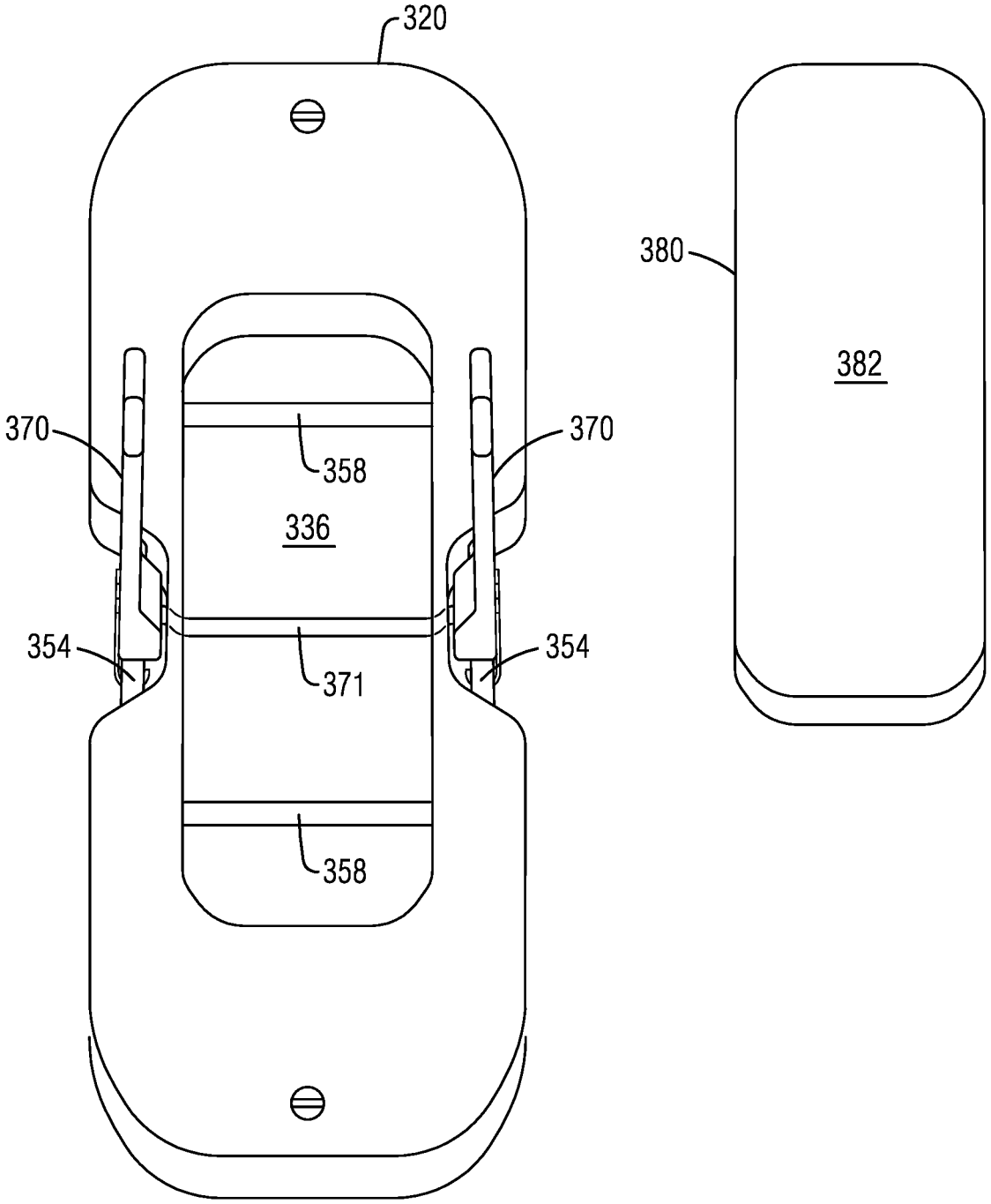
FIG. 16 is a top perspective view of the multi-functional exercise apparatus configured to receive the pair of risers and cross beam support of FIG. 15, in accordance with another representative embodiment of the present disclosure.

In yet another embodiment of the exercise device 310 illustrated in FIGS. 15-16, the pair of risers 370 can further include a crossbeam 371 that connects to the base of each riser at either end, and which is configured to straddle the central aperture 336 underneath the platform insert 380. The crossbeam 371 can serve to better hold and stiffen the risers 370 in their upright positions upon attachment to the elongate body 320, and to better stiffen the center portion of the platform insert 380 mounted over the central aperture. In one aspect the crossbeam may be connected or secured to the side handles, 354, and may also be configured to transfer a portion of the weight applied to the top surface of the platform insert 380 to the side handles 354 of the frame.

Figure 17:
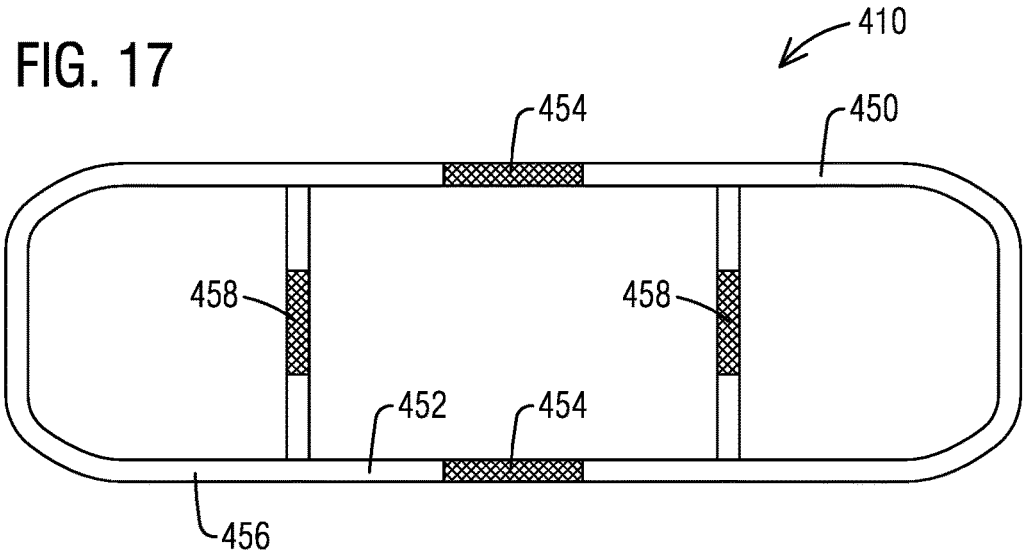
FIG. 17 is a top view of the inner frame of the multi-functional exercise apparatus, in accordance with another representative embodiment of the present disclosure.
Figure 18:
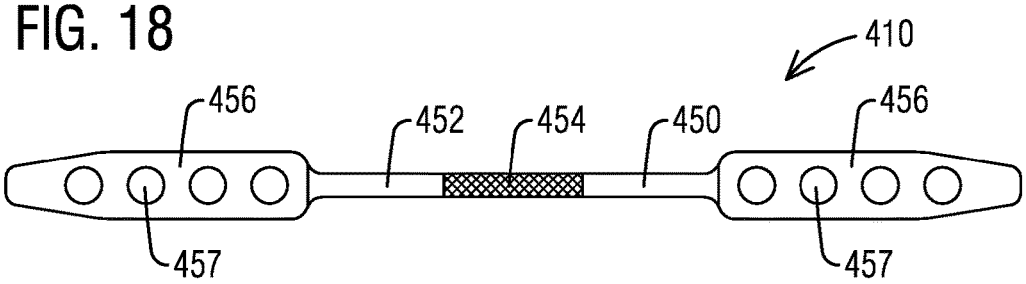
FIG. 18 is a side view of the inner frame of FIG. 17.

FIGS. 17-18 illustrate yet another embodiment of the exercise device 410 in which the inner frame 450 is extended beyond the rectangular frame or skeleton described above to a more widespread configuration that reaches to the end portions of the elongate body. In this embodiment the inner frame 450 can comprise more than steel tubes 452, but also expanded sections 456 that can better support the end portions of the elongate body. In one aspect the expanded sections 456 can also include one or more side channel aperture 457 that provide access and structure to the series of side chambers described above. As shown in the drawings, both the side handles 454 and the aperture handles 458 can be textured with knurling or similar surface treatment or rubberized for better grip.

Figure 19:
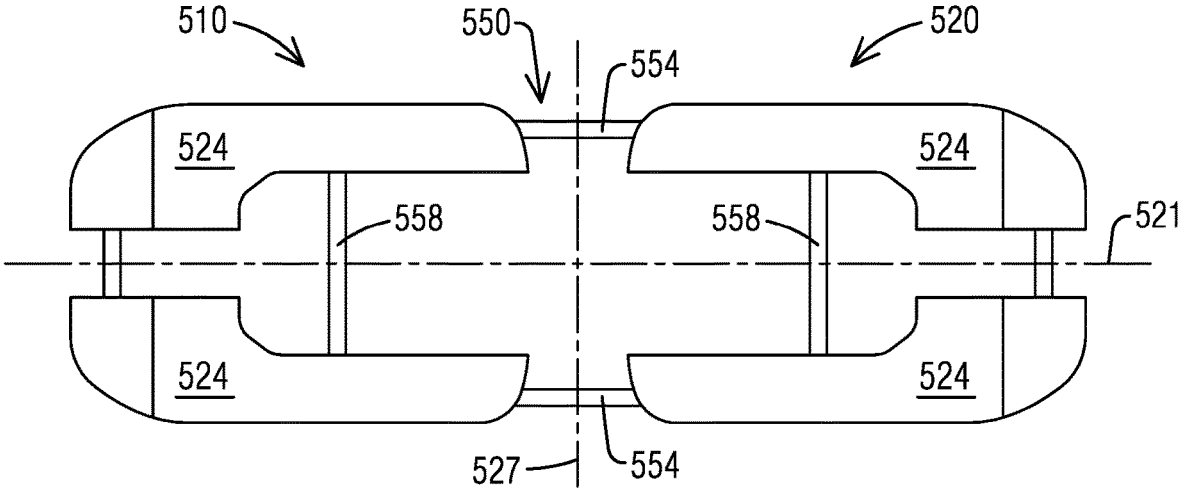
FIG. 19 is a top view of the multi-functional exercise apparatus configured for sliding expansion along its inner frame, in accordance with another representative embodiment of the present disclosure.

An expandable version of the exercise device 510 is shown in FIG. 19, in which the elongate body 520 can be split or separated into multiple pieces, such as the four quadrants 524, that can slide outwardly along the inner frame 550 to lock in an expanded configuration. In one aspect the elongate body pieces 524 can slide outwardly along both the longitudinal axis 521 and the transverse axis 527, as illustrated in the drawing. In other aspects (not shown), the elongate body can be split or separable into two halves along the transverse axis 527, and then outwardly slidable along the longitudinal axis 521, or it can be split or separable into two halves along the longitudinal axis 521, and then outwardly slidable along the transverse axis 527. In each expanded configuration the separate pieces of the elongate body can be locked into their end positions relative to the internal frame 550 so as to create increased moments of inertia (i.e. resistance) that require additional work and effort as would be required to perform the same exercise in the non-expanded configuration. In this way the expandable version of the exercise device 510 can provide a user with variable resistance for a number of weighted body exercises without adding additional mass.

FIGS. 20-26 illustrate a non-exclusive group of exercises which can be performed by an athlete who is using the exercise apparatus of the present disclosure as a platform. For instance, FIG. 20 is a schematic drawing of a user or athlete 600 using the exercise apparatus 610 with the installed platform insert 680 as a platform to perform a plyometric jumping exercise with elastic resistance, in which bungee cords 679 are secured at one end to the anchor points 625 formed into the elongate body 620 and at the other end to a harness 690 that is strapped around the waist of the user.

Figure 21:
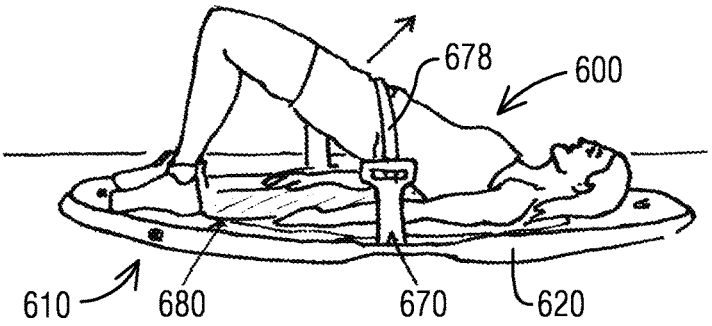
FIG. 21 is a schematic drawing of an athlete using the exercise apparatus as a platform to perform a "bridge" core strengthening exercise with elastic resistance.

FIG. 21 is a schematic drawing of an athlete 600 using the elongate body 620 of the exercise apparatus 610 with the installed platform insert 680 as a platform to perform a "bridge" core strengthening exercise, with additional elastic resistance being provided by the resistance band 678 secured between the upstanding risers 670.

Figure 22:
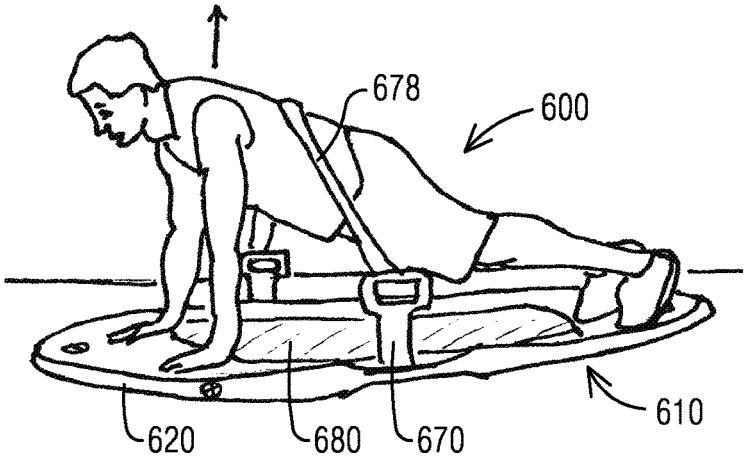
FIG. 22 is a schematic drawing of an athlete using the exercise apparatus as a platform to perform a push up exercise with elastic resistance.

FIG. 22 is a schematic drawing of an athlete 600 using the elongate body 620 of the exercise apparatus 610 with the installed platform insert 680 as a platform to perform a push up exercise, with additional elastic resistance being provided by the resistance band 678 secured between the upstanding risers 670.

Figure 23:
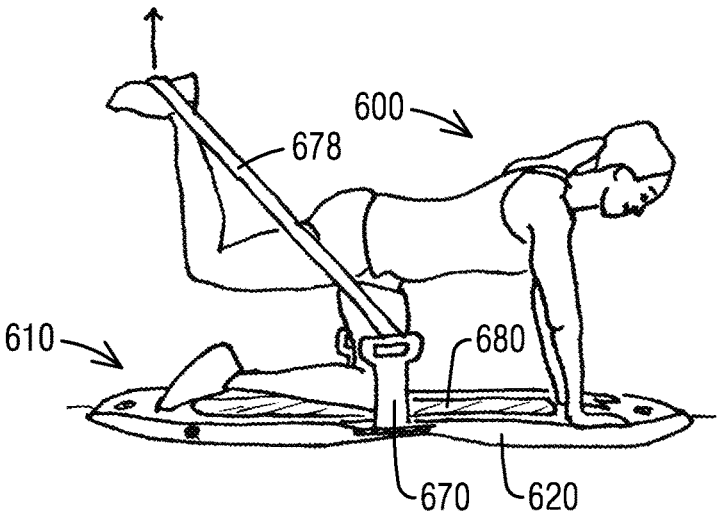
FIG. 23 is a schematic drawing of an athlete using the exercise apparatus as a platform to perform a "donkey kick" exercise with elastic resistance.

FIG. 23 is a schematic drawing of an athlete 600 using the elongate body 620 of the exercise apparatus 610 with the installed platform insert 680 as a platform to perform a "donkey kick" exercise, with additional elastic resistance being provided by the resistance band 678 secured between the upstanding risers 670.

Figure 24:
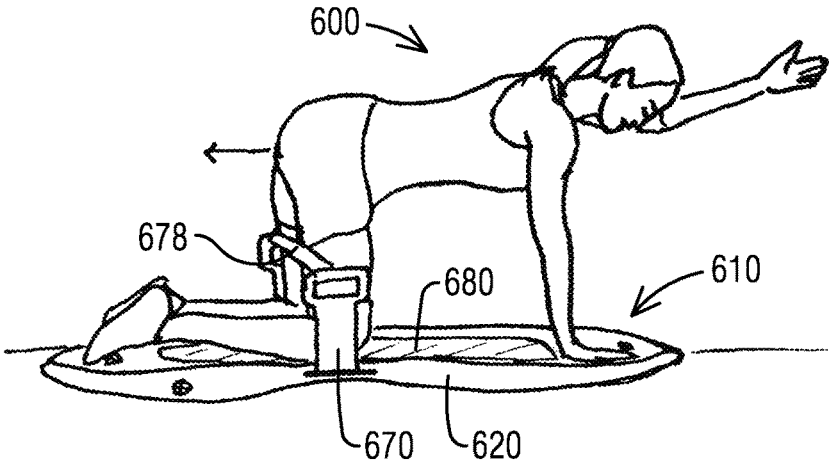
FIG. 24 is a schematic drawing of an athlete using the exercise apparatus as a platform to perform a quadruped reach exercise with elastic resistance.

FIG. 24 is a schematic drawing of an athlete 600 using the elongate body 620 of the exercise apparatus 610 with the installed platform insert 680 as a platform to perform a 'quadruped reach' exercise (i.e. a reaching exercise that is performed while positioned on hands and knees), with additional elastic resistance being provided by the resistance band 678 secured between the upstanding risers 670.

Figure 25:
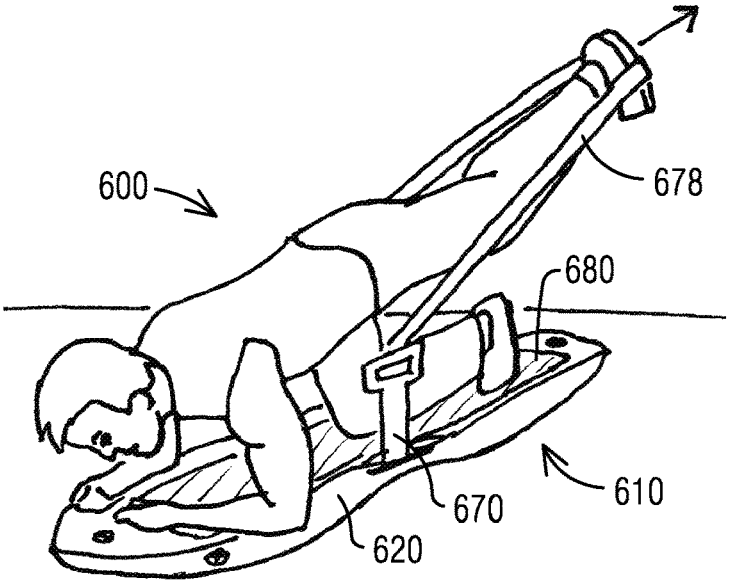
FIG. 25 is a schematic drawing of an athlete using the exercise apparatus as a platform to perform a kick back exercise with elastic resistance.

FIG. 25 is a schematic drawing of an athlete 600 using the elongate body 620 of the exercise apparatus 610 with the installed platform insert 680 as a platform to perform a kick back exercise, with additional elastic resistance being provided by the resistance band 678 secured between the upstanding risers 670.

Figure 26:
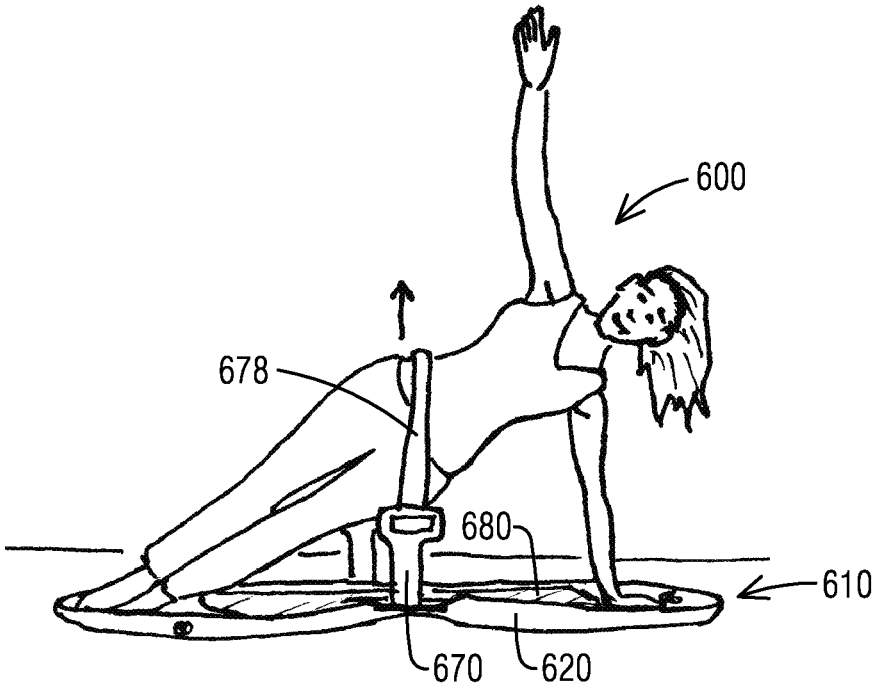
FIG. 26 is a schematic drawing of an athlete using the exercise apparatus as a platform to perform a side plank exercise with elastic resistance.

FIG. 26 is a schematic drawing of an athlete 600 using the elongate body 620 of the exercise apparatus 610 with the installed platform insert 680 as a platform to perform a side plank exercise, with additional elastic resistance being provided by the resistance band 678 secured between the upstanding risers 670.

Figure 27:
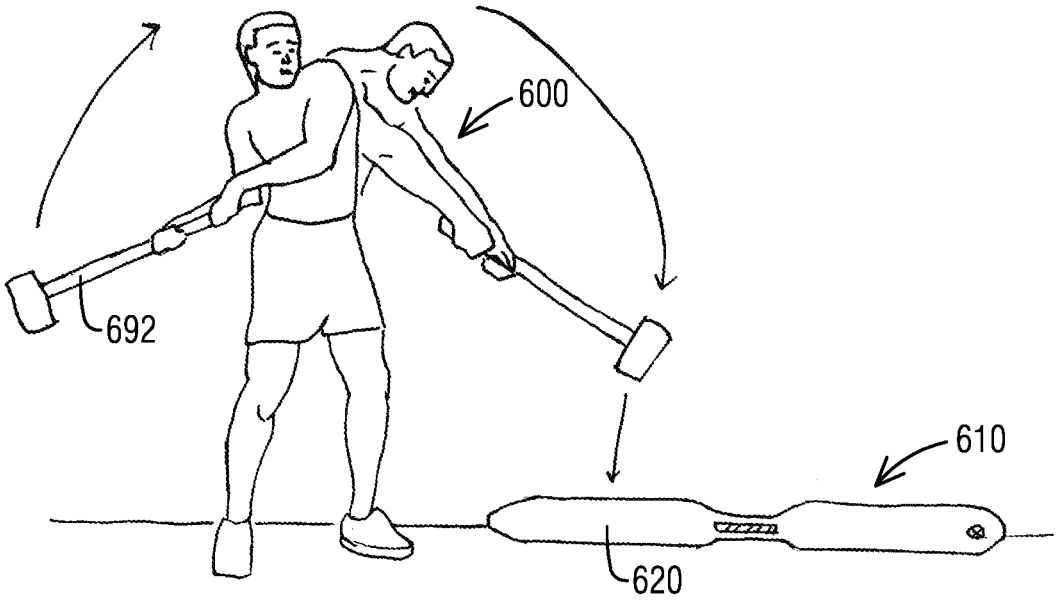
FIG. 27 is a schematic drawing of an athlete using the exercise apparatus as a target body to perform a sledge hammer exercise.

In other aspects the exercise apparatus of the present disclosure can be used as a target body. For example, FIG. 27 is a schematic drawing of an athlete 600 using the elongate body 620 of the exercise apparatus 610 as a target for striking with a sledge hammer 692 while performing a sledge hammer exercise.

Figure 28:
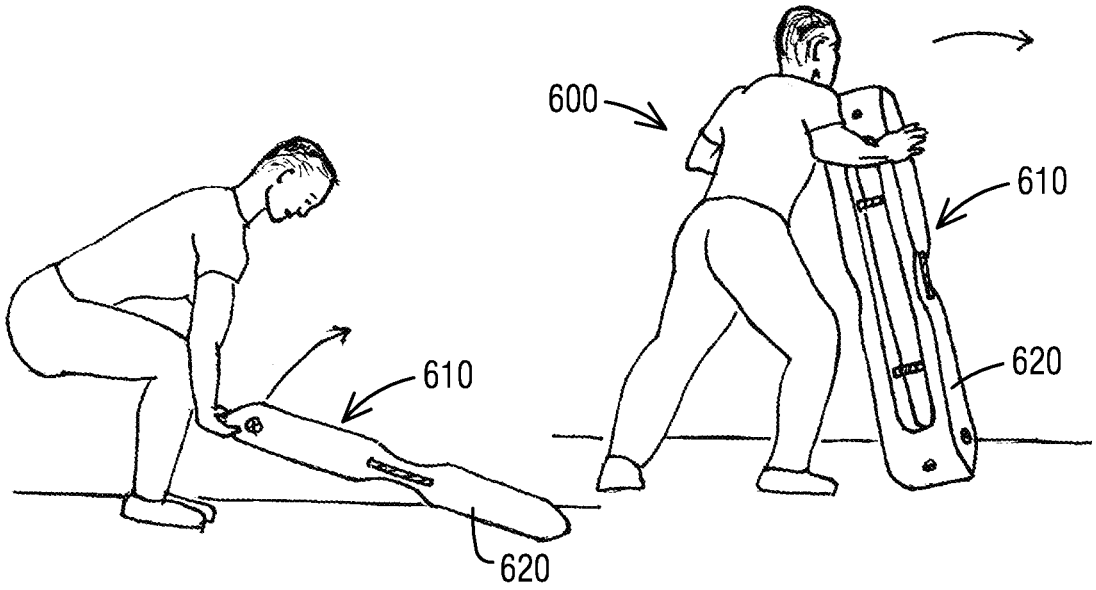
FIG. 28 is a schematic drawing of an athlete using the exercise apparatus as a weighted body to perform a tire flip exercise.

FIGS. 28-38 illustrate a non-exclusive group of exercises which can be performed by an athlete who is using the exercise apparatus of the present disclosure as a weight body. For instance, FIG. 28 is a schematic drawing of an athlete 600 using the elongate body 620 of the exercise apparatus 610, perhaps with added weight, as a weighted body to perform a tire flip exercise.

FIG. 29 is a schematic drawing of an athlete 600 using the elongate body 620 of the exercise apparatus 610 as a weighted body, perhaps with added weight, to perform a sled drag exercise, with a strap, rope, or bungee cord 679 being securing at one end to an anchor point 625 formed into the elongate body 620 and at the other end to a harness 690 that is strapped around the waist of the user.

FIG. 30 is a schematic drawing of an athlete 600 using the elongate body 620 of the exercise apparatus 610 as a weighted body, perhaps with added weight, to perform a sled pull exercise, with a strap or rope 677 being securing at one end to an anchor point 625 formed into the elongate body 620.

Figure 31:
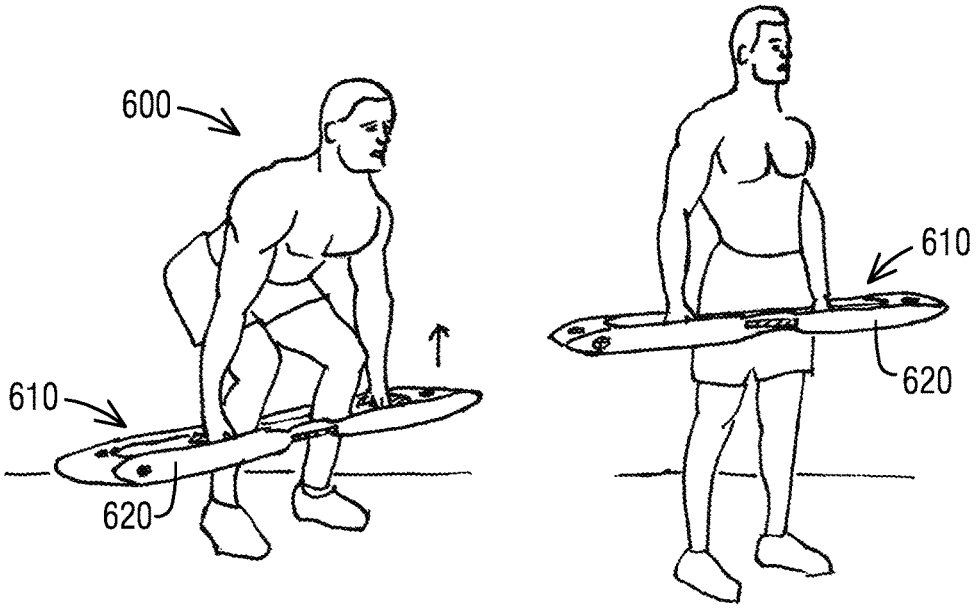
FIG. 31 is a schematic drawing of an athlete using the exercise apparatus as a weighted body to perform a dead lift exercise.

FIG. 31 is a schematic drawing of an athlete 600 using the elongate body 620 of the exercise apparatus 610 as a weighted body, perhaps with added weight, to perform a dead lift exercise.

Figure 32:
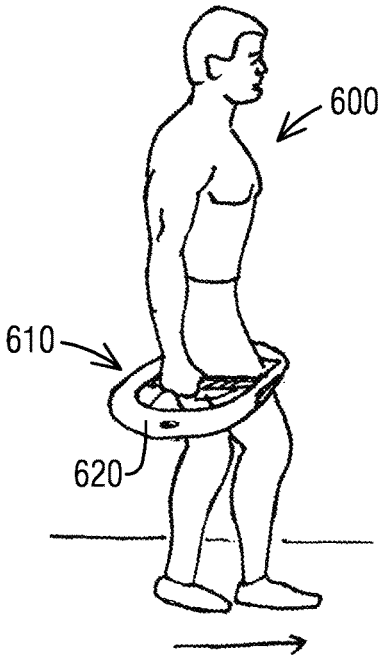
FIG. 32 is a schematic drawing of an athlete using the exercise apparatus as a weighted body to perform a farmer's carry exercise.

FIG. 32 is a schematic drawing of an athlete 600 using the elongate body 620 of the exercise apparatus 610 as a weighted body, perhaps with added weight, to perform a farmer's carry exercise.

Figure 33:
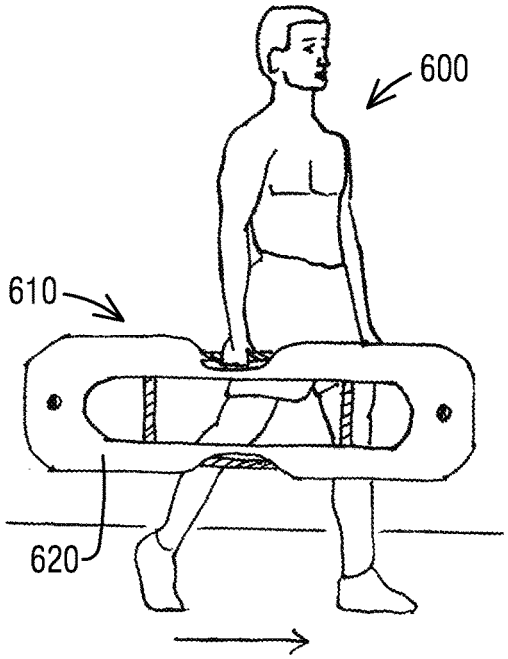
FIG. 33 is a schematic drawing of an athlete using the exercise apparatus as a weighted body to perform a single arm carry exercise.

FIG. 33 is a schematic drawing of an athlete 600 using the elongate body 620 of the exercise apparatus 610 as a weighted body, perhaps with added weight, to perform a single arm carry exercise.

Figure 34:
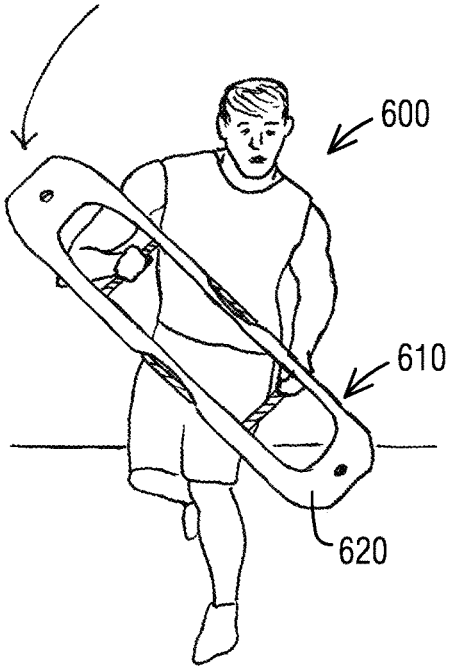
FIG. 34 is a schematic drawing of an athlete using the exercise apparatus as a weighted body to perform a core woodchopper exercise.

FIG. 34 is a schematic drawing of an athlete 600 using the elongate body 620 of the exercise apparatus 610 as a weighted body to perform a core woodchopper exercise.

Figure 35:
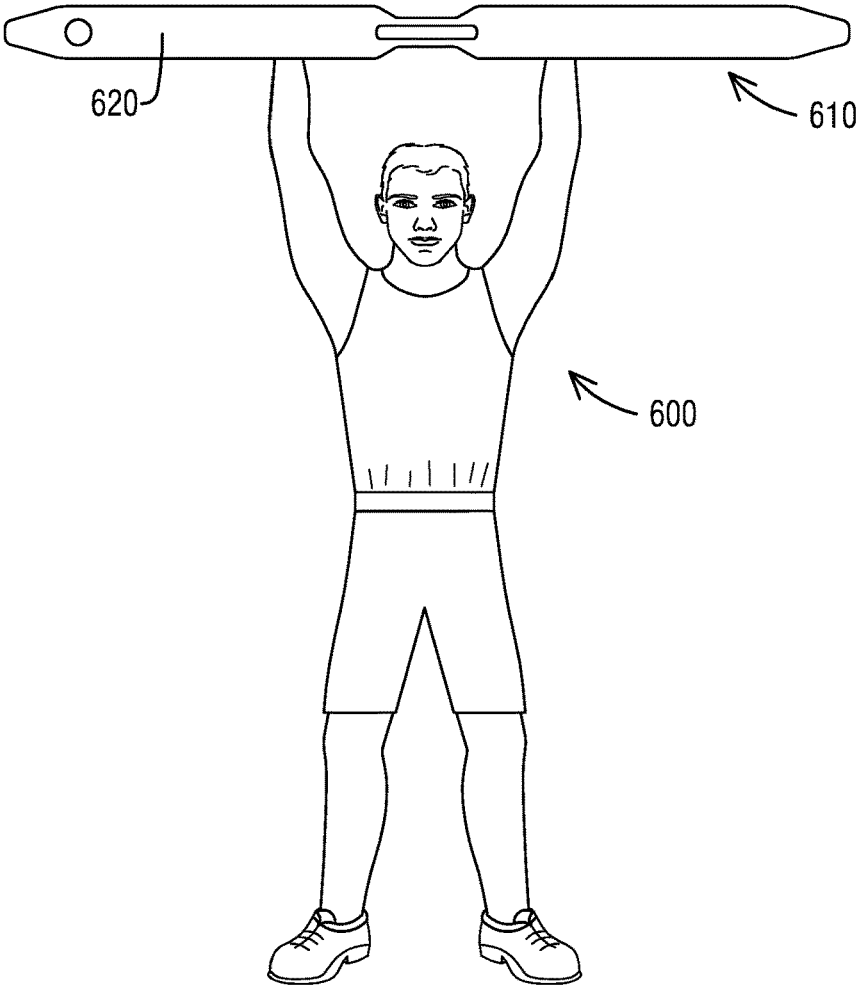
FIG. 35 is a schematic drawing of an athlete using the exercise apparatus as a weighted body to complete an overhead press exercise.

FIG. 35 is a schematic drawing of an athlete 600 using the elongate body 620 of the exercise apparatus 610 as a weighted body to complete an overhead press exercise.

Figure 36:
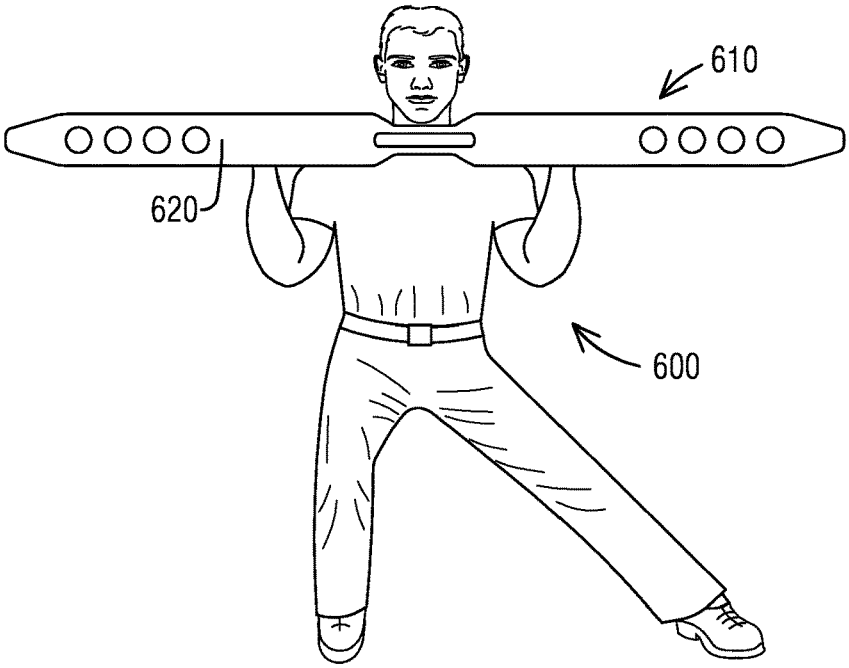
FIG. 36 is a schematic drawing of an athlete using the exercise apparatus as a weighted body to perform a weighted side lung exercise.

FIG. 36 is a schematic drawing of an athlete 600 using the elongate body 620 of the exercise apparatus 610 as a weighted body to perform a weighted side lung exercise, in which the elongate body 620 is operable for lowering from an overhead press position above the head of the user down around the shoulders of the user with the longitudinal axis of the elongate body being aligned with the spine of the user when the spine of the user is in an upright and neutral position.

Figure 37:
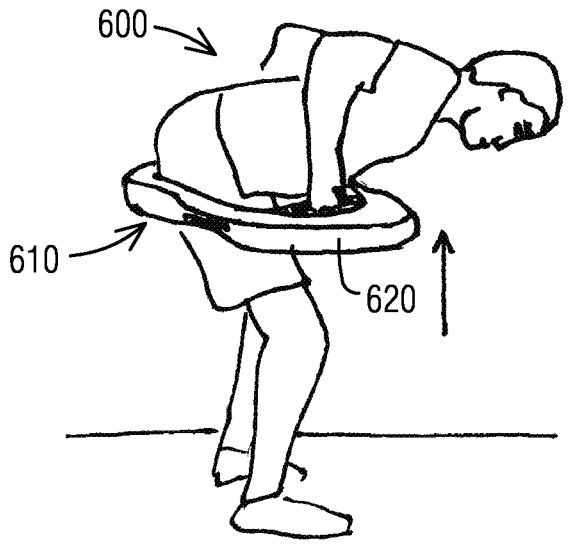
FIG. 37 is a schematic drawing of an athlete using the exercise apparatus as a weighted body to perform a bent-over row exercise.

FIG. 37 is a schematic drawing of an athlete 600 positioned within the aperture of the elongate body 620 to use the exercise apparatus 610 as a weighted body to perform a bent-over row exercise.

Figure 38:
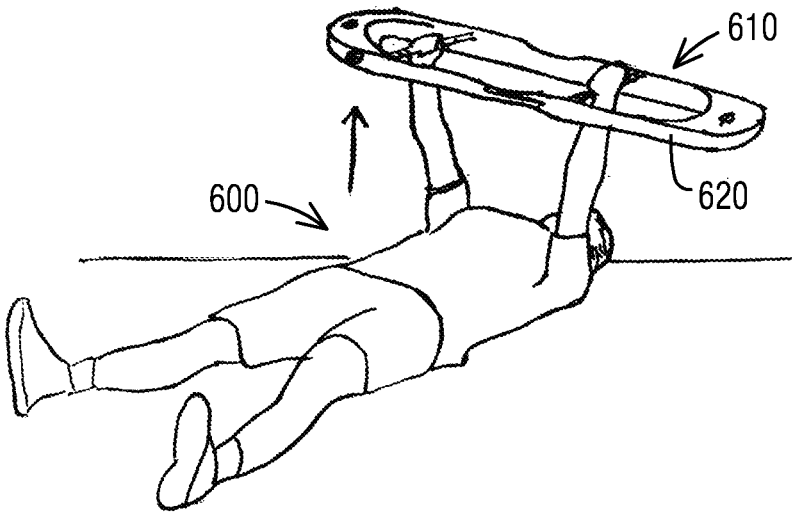
FIG. 38 is a schematic drawing of an athlete using the exercise apparatus as a weighted body to perform a chest press exercise.

FIG. 38 is a schematic drawing of an athlete 600 using the elongate body 620 of the exercise apparatus 610 as a weighted body to perform a chest press exercise.

As indicated above, the disclosure has been described herein in terms of preferred embodiments and methodologies considered by the inventor to represent the best mode of carrying out the invention. It will be understood by the skilled artisan, however, that a wide range of additions, deletions, and modifications, both subtle and gross, may be made to the illustrated and exemplary embodiments of the multi-functional exercise apparatus without departing from the spirit and scope of the disclosure. These and other revisions might be made by those of skill in the art without departing from the spirit and scope of the invention that is constrained only by the following claims.

What is claimed is:

1. A multi-functional exercise apparatus for performing both isolated lower body, core, and upper body resistance training exercises and full-body strength training exercises to improve a fitness of a user, the exercise apparatus comprising:

an elongate body having a length along a longitudinal axis between end walls, a width along a transverse axis between sidewalls, and a thickness between a first surface and a second surface, with the first and second surfaces being substantially planar across a center portion of the elongate body;

a central aperture defined through the thickness of the elongate body, the central aperture having an aperture length between aperture ends configured to accommodate a shoulder width of the user, and an aperture width between aperture sides configured to accommodate a chest-to-back thickness of the user;

a handle proximate to each aperture end configured for gripping by hands of the user; and at least one empty volume formed between each aperture end and an adjacent end wall of the elongate body and configured to removably receive an additional mass for increasing a weight of the elongate body, wherein the elongate body is formed from a resilient and impact resistant material and includes an inner frame made from a rigid material positioned therein for structural support, and wherein the thickness of the elongate body is greater than or about three inches.

2. The exercise apparatus of claim 1, wherein the resilient and impact resistant material is selected from the group consisting of a hard rubber composite, a fiberglass composite, a Kevlar composite, a plastic composite, and wood.

3. The exercise apparatus of claim 1, wherein the rigid material is selected from the group consisting of metal, steel, aluminum, carbon fiber, and structural plastic.

4. The exercise apparatus of claim 1, wherein the elongate body is separable along the transverse axis into two halves that slidably expand outward along the inner frame.

5. The exercise apparatus of claim 1, wherein the handles proximate to each respective aperture end further comprise bars extending between the aperture sides and spaced from the aperture ends.

6. The exercise apparatus of claim 1, wherein the handles proximate to each respective aperture end further comprise exposed portions of the inner frame comprising tubular bars.

7. The exercise apparatus of claim 1, wherein the elongate body is operable for lowering from an overhead press position above a head of the user down around shoulders of the user with the longitudinal axis of the elongate body configured to be aligned with a spine of the user when the spine of the user is in an upright and neutral position.

8. The exercise apparatus of claim 1, wherein the at least one empty volume further comprises at least one side chamber extending parallel to the transverse axis of the elongate body and opening from one of the sidewalls of the elongate body, and configured for receiving the additional mass for increasing the weight of the elongate body, wherein the additional mass is a weighted insert of known mass.

9. The exercise apparatus of claim 8, wherein the weighted insert further comprises a rod of known weight that is securable within the at least one side chamber.

10. The exercise apparatus of claim 9, wherein the rod of known weight has a tubular construction.

11. The exercise apparatus of claim 8, wherein the weighted insert further comprises a sealable cylinder filled with a liquid to define a known weight and that is securable within the at least one side chamber.

12. The exercise apparatus of claim 1, wherein the at least one empty volume further comprises a sealable chamber adapted for filling with a liquid to define a known weight.

13. The exercise apparatus of claim 1, wherein the at least one empty volume is only partially filled with a fluid medium to create a dynamic shifting of the additional mass during exercise.

14. The exercise apparatus of claim 1, further comprising a platform removably supported on the handles to cover the central aperture.

15. The exercise apparatus of claim 14, wherein a top surface of the platform is substantially flush with the first surface of the elongate body.

16. The exercise apparatus of claim 14, further comprising:

a pair of riser supports removably securable to the elongate body respectively proximate to the aperture sides to extend upward out-of-plane from the first surface; and a stretchable resistance band securable to the pair of riser supports to extend transversely across the platform covering the central aperture.

17. The exercise apparatus of claim 1, further comprising at least one attachment point proximate to the end walls of the elongate body and configured for securing a cord for pulling the elongate body along its longitudinal axis over a ground surface.

18. A multi-functional exercise apparatus for performing both isolated lower body, core, and upper body resistance training exercises and full-body strength training exercises to improve a fitness of a user, the exercise apparatus comprising:

an elongate body having a length along a longitudinal axis between end walls, a width along a transverse axis between sidewalls, and a thickness between a first surface and a second surface, with the first and second surfaces being substantially planar across a center portion of the elongate body;

a central aperture defined through the thickness of the elongate body, the central aperture having an aperture length between aperture ends configured to accommodate a shoulder width of the user, and an aperture width between aperture sides configured to accommodate a chest-to-back thickness of the user;

a handle proximate to each aperture end configured for gripping by hands of the user; and at least one empty volume formed between each aperture end and an adjacent end wall of the elongate body and configured to removably receive an additional mass for increasing a weight of the elongate body, wherein the elongate body is formed from a resilient and impact resistant material and includes an inner frame made from a rigid material positioned therein for structural support, and wherein the first and second surfaces include curved end portions that curve inwardly to substantially flat end wall surfaces, the substantially flat end wall surfaces having a height less than about two-thirds the thickness of the elongate body.

19. The exercise apparatus of claim 18, wherein the substantially planar portions of the first and second surfaces are smooth to facilitate sliding across a ground surface and the curved end portions of the first and second surfaces are textured to provide a gripping surface.

20. A multi-functional exercise apparatus for performing both isolated lower body, core, and upper body resistance training exercises and full-body strength training exercises to improve a fitness of a user, the exercise apparatus comprising:

an elongate body having a length along a longitudinal axis between end walls, a width along a transverse axis between sidewalls, and a thickness between a first surface and a second surface, with the first and second surfaces being substantially planar across a center portion of the elongate body;

a central aperture defined through the thickness of the elongate body, the central aperture having an aperture length between aperture ends configured to accommodate a shoulder width of the user, and an aperture width between aperture sides configured to accommodate a chest-to-back thickness of the user;

a handle proximate to each aperture end configured for gripping by hands of the user; and at least one empty volume formed between each aperture end and an adjacent end wall of the elongate body and configured to removably receive an additional mass for increasing a weight of the elongate body, wherein the elongate body is formed from a resilient and impact resistant material and includes an inner frame made from a rigid material positioned therein for structural support, and wherein the sidewalls curve inwardly toward the end walls of the elongate body to substantially flat end wall surfaces, the substantially flat end wall surfaces having a width less than about two-thirds the width of the elongate body.

* * * * *